US009306375B2

(12) United States Patent
Ozeki et al.

(10) Patent No.: US 9,306,375 B2
(45) Date of Patent: Apr. 5, 2016

(54) SPARK PLUG

(71) Applicant: NGK Spark Plug Co., LTD., Nagoya (JP)

(72) Inventors: Keiji Ozeki, Konan (JP); Tomoaki Kato, Nagoya (JP); Naoyuki Mukoyama, Nisshin (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 14/409,840

(22) PCT Filed: May 7, 2013

(86) PCT No.: PCT/JP2013/002936
§ 371 (c)(1),
(2) Date: Dec. 19, 2014

(87) PCT Pub. No.: WO2014/013654
PCT Pub. Date: Jan. 23, 2014

(65) Prior Publication Data

US 2015/0188293 A1 Jul. 2, 2015

(30) Foreign Application Priority Data

Jul. 17, 2012 (JP) ..... 2012-158280
Aug. 28, 2012 (JP) ..... 2012-187283

(51) Int. Cl.
*H01T 13/36* (2006.01)

(52) U.S. Cl.
CPC ..... *H01T 13/36* (2013.01)

(58) Field of Classification Search
None
See application file for complete search history.

(56) References Cited

U.S. PATENT DOCUMENTS 2,250,355 A 7/1941 Bruck
6,414,420 B1 7/2002 Suzuki
(Continued)

FOREIGN PATENT DOCUMENTS

EP 429407 A 5/1991
EP 2383847 A 11/2011
(Continued)

OTHER PUBLICATIONS

International Search Report mailed Aug. 6, 2013 for the corresponding PCT Application No. PCT/JP2013/002936.
(Continued)

*Primary Examiner* — Ashok Patel
(74) *Attorney, Agent, or Firm* — Leason Ellis LLP

(57) ABSTRACT

A spark plug includes a center electrode, an insulator, a metallic shell, and a seal member for providing a seal between the insulator and the metallic shell. The insulator includes a first portion, a second portion located axially forward of the first portion and being smaller than the first portion, and an insulator first-diameter-reducing-portion whose outside diameter reduces forward and which connects the first portion and the second portion. The metallic shell includes a protrusion that includes a metallic shell diameter-reducing-portion whose inside diameter reduces forward. The seal member is disposed between the insulator first-diameter-reducing-portion and the metallic shell diameter-reducing-portion. A relationship θ21>θ22 is satisfied, where the angle θ21 is an angle between a straight line orthogonal to the axial line and the outline of the metallic shell diameter-reducing-portion, and the angle θ22 is an angle between the straight line and an outline of the insulator first-diameter-reducing-portion.

16 Claims, 14 Drawing Sheets

(56) References Cited

U.S. PATENT DOCUMENTS

| | | | | |
|---|---|---|---|---|
| 2002/0041135 | A1 | 4/2002 | Fukushima et al. | |
| 2003/0168954 | A1 | 9/2003 | Suzuki | |
| 2005/0184633 | A1* | 8/2005 | Kato | 313/141 |
| 2006/0022566 | A1 | 2/2006 | Ishiguro | |
| 2007/0046162 | A1 | 3/2007 | Moribe et al. | |
| 2008/0054778 | A1 | 3/2008 | Kumagai et al. | |
| 2011/0181168 | A1* | 7/2011 | Nakamura et al. | 313/144 |
| 2011/0254428 | A1 | 10/2011 | Kyuno et al. | |
| 2011/0298353 | A1 | 12/2011 | Nakamura et al. | |
| 2012/0001533 | A1* | 1/2012 | Sakayanagi et al. | 313/141 |
| 2012/0267995 | A1* | 10/2012 | Shimamura et al. | 313/143 |
| 2012/0313503 | A1* | 12/2012 | Kasuya et al. | 313/141 |
| 2013/0015756 | A1 | 1/2013 | Yamada et al. | |

FOREIGN PATENT DOCUMENTS

| | | | |
|---|---|---|---|
| GB | 135735 | A | 12/1919 |
| JP | 50-114524 | U | 9/1975 |
| JP | 02-183989 | A | 7/1990 |
| JP | 03-165480 | A | 7/1991 |
| JP | 3502936 | B | 3/2004 |
| JP | 2006-66385 | A | 3/2006 |
| JP | 2007-258142 | A | 10/2007 |
| JP | 2008-84841 | A | 4/2008 |
| JP | 4267855 | B | 5/2009 |
| JP | 4268771 | B | 5/2009 |
| JP | 2009-176525 | A | 8/2009 |
| JP | 2010-192184 | A | 9/2010 |
| JP | 4548818 | B | 9/2010 |
| JP | 2011-210699 | A | 10/2011 |
| JP | 2013-101777 | A | 5/2013 |
| WO | WO-2010/035717 | A | 4/2010 |
| WO | WO-2011/125306 | A | 10/2011 |

OTHER PUBLICATIONS

Extended European Search Report mailed Feb. 8, 2016 for the corresponding European Application No. 13820698.2.

* cited by examiner (C)

| | | St(mm²) | | | | |
|---|---|---|---|---|---|---|
| | | 10 | 11 | 12 | 13 | 14 |
| θ 1 (deg.) | 25 | × | × | × | × | ○ |
| | 27 | ○ | ○ | ○ | ○ | ○ |
| | 30 | ○ | ○ | ○ | ○ | ○ |
| | 35 | ○ | ○ | ○ | ○ | ○ |
| | 40 | ○ | ○ | ○ | ○ | ○ |
| | 50 | ○ | ○ | ○ | ○ | ○ |

COMPARATIVE EXAMPLE

θ22<30°

MODE A

MODE B

MODE C

COMPARATIVE EXAMPLE

SPARK PLUG

CROSS-REFERENCE TO RELATED PATENT APPLICATIONS

This application is a U.S. National Phase application under 35 U.S.C. §371 of International Patent Application No. PCT/JP2013/002936, filed May 7, 2013, and claims the benefit of Japanese Patent Applications No. 2012-158280, filed on Jul. 17, 2012, and No. 2012-187283, filed Aug. 28, 2012, all of which are incorporated by reference in their entirety herein. The International application was published in Japanese on Jan. 23, 2014 as International Publication No. WO/2014/013654 under PCT Article 21(2).

FIELD OF THE INVENTION

The present invention relates to a spark plug for an internal combustion engine.

BACKGROUND OF THE INVENTION

A spark plug for use in an internal combustion engine is required to reduce its size or diameter for the purpose of, for example, improving the degree of freedom for design of the internal combustion engine. Specifically, as a result of reducing the diameter of the spark plug, a mounting hole for the spark plug can be reduced in diameter, whereby the degree of freedom can be improved for design of an intake port and an exhaust port. However, reducing the size or diameter of the spark plug is accompanied by a reduction in the diameter of an insulator, so that the mechanical strength of the insulator deteriorates. A deterioration in mechanical strength of the insulator may affect the performance of the spark plug.

For example, Patent Document 1 mentioned below discloses a spark plug in which a packing higher in hardness than a metallic shell is disposed between a diameter reducing portion (stepped portion) of an insulator at which the outside diameter of the insulator reduces, and a diameter reducing portion (stepped portion) of the metallic shell at which the inside diameter of the metallic shell reduces. In manufacture of the spark plug, when the spark plug is assembled through crimping, a portion of the packing is dug into the diameter reducing portion of the metallic shell, thereby providing a seal between the insulator and the metallic shell.

PRIOR ART DOCUMENTS

Patent Documents

Patent Document 1: Japanese Patent Application Laid-Open (kokai) No. 2008-84841

Patent Document 2: Japanese Patent Application Laid-Open (kokai) No. 2010-192184

Patent Document 3: Japanese Patent Application Laid-Open (kokai) No. 2007-258142

Patent Document 4: Japanese Patent Application Laid-Open (kokai) No. 2009-176525

Patent Document 5: Japanese Patent No. 3502936

Patent Document 6: Japanese Patent No. 4548818

Patent Document 7: Japanese Patent No. 4268771

Patent Document 8: Japanese Patent No. 4267855

Patent Document 9: Japanese Patent Application Laid-Open (kokai) No. 2006-66385

Problem to be Solved by the Invention

In the spark plug of Patent Document 1, in the case of insufficient deformation of the diameter reducing portion of the metallic shell, sufficient seal performance may fail to be ensured between the insulator and the metallic shell. By contrast, in the case of excessive deformation of the diameter reducing portion of the metallic shell, the deformed diameter reducing portion of the metallic shell causes an inner circumferential portion of the packing to be pressed against the insulator. As a result, the insulator whose mechanical strength is deteriorated as a result of a reduction in size or diameter may be damaged. In the case of unintentional deformation of that portion of the metallic shell which is in contact with the packing, in some cases, seal performance has deteriorated as a result of reception of vibration of an internal combustion engine (i.e., vibration of the spark plug). Furthermore, in the case where the diameter reducing portion of the metallic shell is excessively deformed such that the diameter reducing portion becomes partially depressed, the relative position between the metallic shell and the insulator changes; as a result, the insulator protruding dimension may change. The insulator protruding dimension is a distance along which the forward end surface of the insulator protrudes from the forward end surface of the metallic shell towards the forward of the spark plugs. Since a change of the insulator protruding dimension leads to a change of a thermal value characteristic, a change of the insulator protruding dimension is undesirable in view of manufacture of a large number of spark plugs having fixed performance.

Such a problem is not limited to the spark plug of Patent Document 1, but is common to various spark plugs having a seal member disposed between a diameter reducing portion of the insulator and a diameter reducing portion of the metallic shell.

The present invention has been conceived to solve, at least partially, the above problem and can be embodied in the following modes or embodiments.

SUMMARY OF THE INVENTION

Embodiment 1

A spark plug comprising a rodlike center electrode extending along an axial line, an insulator having an axial hole extending along the axial line and holding the center electrode in the axial hole in such a manner that the center electrode protrudes axially forward from the axial hole, a metallic shell holding the insulator in such a manner as to circumferentially surround a portion of the insulator, and an annular seal member for providing a seal between the insulator and the metallic shell, the insulator comprising a first portion, a second portion located axially forward of the first portion and being smaller in outside diameter than the first portion, and an insulator first-diameter-reducing-portion whose outside diameter reduces axially forward and which connects the first portion and the second portion, the metallic shell comprising a protrusion protruding radially inward, and the protrusion comprising a metallic shell diameter-reducing-portion whose inside diameter reduces axially forward, and the seal member being disposed between the insulator first-diameter-reducing-portion and the metallic shell diameter-reducing-portion at such a position as to cross an extension line formed by imaginarily extending an outer surface of the first portion in an axially forward direction, wherein an angle θ21 and an angle θ22 satisfy a relational expression $$\theta 21 > \theta 22$$

where, on a section which contains the axial line, the first angle θ21 is an acute angle between a straight line orthogonal to the axial line and an outline of the metallic shell diameter-reducing-portion, and the second angle θ22 is an acute angle between a straight line orthogonal to the axial line and an outline of the insulator first-diameter-reducing-portion.

According to the spark plug, the metallic shell diameter-reducing-portion receives load from the seal member such that a load imposed on the portion at an outer circumference side is greater than a load imposed on the portion at an inner circumference side. That is, an unbalanced load is imposed on the metallic shell diameter-reducing-portion at the outer circumference side such that surface pressure applied to the portion at the outer circumference side increases locally. Therefore, seal performance between the insulator and the metallic shell can be improved. Also, since surface pressure imposed on the metallic shell diameter-reducing-portion at the inner circumference side is relatively reduced, there can be restrained deformation of the protrusion such that the protrusion projects toward the insulator as a result of reception of load from the seal member. As a result, the following problem can be restrained: the deformed protrusion causes an inner circumferential portion of the seal member to be pressed against the insulator and thus damages the insulator.

Embodiment 2

A spark plug according to embodiment 1, wherein the angle θ22 satisfies a relational expression θ22≥30°.

According to the spark plug, a load which is imposed on the metallic shell diameter-reducing-portion in a direction intersecting with the axial line can be increased to a certain extent. Therefore, even in the case of reception of vibration in a direction intersecting with the axial line, the relative positional relation between the metallic shell diameter-reducing-portion and the seal member is unlikely to change, so that seal performance can be improved.

Embodiment 3

A spark plug according to embodiment 1 or 2, wherein the first angle θ21 and the second angle θ22 satisfy a relational expression θ21−θ22≤7°.

According to the spark plug, load applied in a biased manner to the metallic shell diameter-reducing-portion at the outer circumference side can be set to an appropriate range. Therefore, the following problem can be restrained: the biased load becomes excessively large such that the metallic shell diameter-reducing-portion is greatly dented axially forward, resulting in a change of an insulator protruding dimension. That is, variation in the insulator protruding dimension is restrained; as a result, variation in thermal characteristic among spark plugs can be restrained.

Embodiment 4

A spark plug according to any one of embodiments 1 to 3, wherein the seal member is disposed in such a manner as to extend from at least a portion of a space between the insulator first-diameter-reducing-portion and the metallic shell diameter-reducing-portion into a space between the first portion and a portion of the metallic shell located axially rearward of the metallic shell diameter-reducing-portion, and a portion of the seal member in contact with the first portion and with the portion of the metallic shell has an axial length of 0.10 mm or more.

According to the spark plug, even in the case of a potential deterioration in seal performance as a result of the spark plug being excessively tightened to an internal combustion engine, accordingly the protrusion being elongated axially forward, and thus a clearance being generated between the metallic shell diameter-reducing-portion and the seal member, good seal performance can be ensured by the portion of the seal member in contact with the first portion and with the portion of the metallic shell located axially rearward of the metallic shell diameter-reducing-portion.

Embodiment 5

A spark plug according to any one of embodiments 1 to 4, wherein the protrusion has a top portion having a fixed smallest inside diameter; the metallic shell diameter-reducing-portion further comprises an intermediate portion connected to the top portion; and an inside diameter ϕ1 of the top portion and an inside diameter ϕ2 of the intermediate portion measured at its rear end point satisfy a relational expression ϕ2/ϕ1≥1.01.

According to the spark plug, the contact region between the metallic shell diameter-reducing-portion and the seal member is usefully reduced. As a result, surface pressure applied from the seal member to the metallic shell diameter-reducing-portion increases, whereby seal performance between the insulator and the metallic shell can be improved.

Embodiment 6

A spark plug according to embodiment 5, wherein an outside diameter ϕ3 of the first portion satisfies a relational expression ϕ2/ϕ3≤0.95.

According to the spark plug, the contact region between the metallic shell diameter-reducing-portion and the seal member is not excessively reduced. As a result, the following problem can be restrained: surface pressure applied to the metallic shell diameter-reducing-portion increases excessively such that the metallic shell diameter-reducing-portion is greatly dented axially forward, resulting in a change of the insulator protruding dimension. That is, variation in the insulator protruding dimension is restrained; as a result, variation in thermal characteristic among spark plugs can be restrained.

Embodiment 7

A spark plug according to embodiment 5 or 6, wherein the intermediate portion comprises a first intermediate portion having a fixed inside diameter and a second intermediate portion which connects the first intermediate portion and the top portion.

According to the spark plug, the first intermediate portion located closer to the seal member than the second intermediate portion has a fixed inside diameter; thus, as compared with a configuration in which the diameter of the intermediate portion reduces along the entire range of the intermediate portion, the distance between the intermediate portion and the insulator becomes greater in the vicinity of the seal member. Therefore, the following problem can be further restrained: the deformed protrusion causes an inner circumferential portion of the seal member to be pressed against the insulator and thus damages the insulator.

The present invention can also be embodied in the following embodiments.

Embodiment 8

A spark plug according to embodiment 1, wherein the metallic shell includes a threaded portion formed on its outer surface and having a nominal diameter of M10; a contact region between the metallic shell diameter-reducing-portion and the seal member has an area of 12.3 $mm^2$ or less; and the first angle is 27 degrees to 50 degrees.

Embodiment 9

A spark plug according to embodiment 8, wherein the insulator includes an insulator second-diameter-reducing-portion which is located axially rearward of the insulator first-diameter-reducing-portion and whose outside diameter reduces axially rearward;

the metallic shell includes a crimped portion which forms a rear end thereof, is located axially rearward of the insulator second-diameter-reducing portion of the insulator, and is bent radially inward;

a filler space is located between the crimped portion and the insulator second-diameter-reducing-portion of the insulator and is surrounded by an inner circumferential surface of the metallic shell and an outer circumferential surface of the insulator, and is filled with a cushioning material;

the filler space has a volume of 119 $mm^3$ to 151 $mm^3$;

the filler space has an axial length of 3 mm or more; and the filler space has a radial width of 0.66 mm or more.

Embodiment 10

A spark plug according to embodiment 8 or 9, wherein the insulator includes an insulator second-diameter-reducing-portion which is located axially rearward of the insulator first-diameter-reducing-portion and whose outside diameter reduces axially rearward;

the metallic shell includes a crimped portion which forms a rear end thereof, is located axially rearward of the insulator second-diameter-reducing portion of the insulator, and is bent radially inward;

a filler space is located between the crimped portion and the insulator second-diameter-reducing-portion of the insulator and is surrounded by an inner circumferential surface of the metallic shell and an outer circumferential surface of the insulator, and is filled with a cushioning material;

a length H1 and a length H2 satisfy a relational expression $$0.13 \leq H1/H2 \leq 0.18$$

where the length H1 is parallel with the axial line and is an axial length of the filler space, and the length H2 parallel with the axial line and is an axial length between a rear end of the filler space and a projection position of a rear end of the insulator first-diameter-reducing-portion of the insulator, the projection position being obtained by projecting the rear end of the insulator first-diameter-reducing-portion of the insulator onto an inner circumferential surface of the metallic shell diameter-reducing-portion of the metallic shell in parallel with the axial line;

the metallic shell includes a groove portion located axially forward of the crimped portion and assuming the form of a depression in the inner circumferential surface thereof; and a forward end of the insulator second-diameter-reducing-portion is located axially rearward of a rear end of the groove portion.

Embodiment 11

A spark plug comprising: a ceramic insulator having a through hole extending along an axial line, and including a first outside diameter reducing portion whose outside diameter reduces axially forward; a metallic shell having a through hole which extends along the axial line and into which the ceramic insulator is inserted, including an inside diameter reducing portion whose inside diameter reduces axially forward, and being fixed to an outer circumference of the ceramic insulator; and a packing held between the first outside diameter reducing portion of the ceramic insulator and the inside diameter reducing portion of the metallic shell; wherein the metallic shell includes a threaded portion formed on its outer surface and having a nominal diameter of M10; a contact region between the inside diameter reducing portion and the packing has an area of 12.3 $mm^2$ or less; a first angle is an acute angle between the inside diameter reducing portion and a plane perpendicular to the axial line and is 27 degrees to 50 degrees; and the first angle is greater than a second angle which is an acute angle between the first outside diameter reducing portion of the ceramic insulator and a plane perpendicular to the axial line.

This configuration restrains deformation of the inside diameter reducing portion of the metallic shell and thus can improve seal performance within the spark plug.

Embodiment 12

A spark plug according to embodiment 11, wherein the ceramic insulator includes a second outside diameter reducing portion which is located axially rearward of the first outside diameter reducing portion and whose outside diameter reduces axially rearward; the metallic shell includes a crimped portion which forms a rear end thereof, is located axially rearward of the second outside diameter reducing portion of the ceramic insulator, and is bent radially inward; a space is located between the crimped portion and the second outside diameter reducing portion of the ceramic insulator and is surrounded by an inner circumferential surface of the metallic shell and an outer circumferential surface of the ceramic insulator, and a cushioning material is charged into the space; a filler space filled with the cushioning material has a volume of 119 $mm^3$ to 151 $mm^3$; the filler space has an axial length of 3 mm or more; and the filler space has a radial width of 0.66 mm or more.

This configuration can improve seal performance between the metallic shell (inside diameter reducing portion) and the first outside diameter reducing portion of the ceramic insulator and seal performance between the metallic shell and the second outside diameter reducing portion of the ceramic insulator.

Embodiment 13

A spark plug according to embodiment 11 or 12, wherein the ceramic insulator includes a second outside diameter reducing portion which is located axially rearward of the first outside diameter reducing portion and whose outside diameter reduces axially rearward; the metallic shell includes a crimped portion which forms a rear end thereof, is located axially rearward of the second outside diameter reducing portion of the ceramic insulator, and is bent radially inward; a space is located between the crimped portion and the second outside diameter reducing portion of the ceramic insulator and is surrounded by an inner circumferential surface of the metallic shell and an outer circumferential surface of the ceramic insulator, and a cushioning material is charged into the space; a length H1 and a length H2 satisfy a relational expression $0.13 \leq H1/H2 \leq 0.18$, where the length H1 is an axial length of the filler space filled with the cushioning material, and the length H2 is an axial length between a rear end of the filler space and a projection position being obtained by projecting the rear end of the first outside diameter reducing portion of the ceramic insulator onto the inner circumferential surface of the diameter-reducing portion of the metallic shell in parallel with the axial line; the metallic shell includes a groove portion located axially forward of the crimped portion and assuming the form of a depression in the inner circumferential surface thereof; and a forward end of the second outside diameter reducing portion is located axially rearward of a rear end of the groove portion.

This configuration can improve seal performance between the metallic shell (inside diameter reducing portion) and the first outside diameter reducing portion of the ceramic insulator and seal performance between the metallic shell and the second outside diameter reducing portion of the ceramic insulator.

The present invention can be embodied in various forms; for example, spark plugs and internal combustion engines equipped with spark plugs.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

A. First Embodiment

A-1. Configuration of Spark Plug

Figure 1:
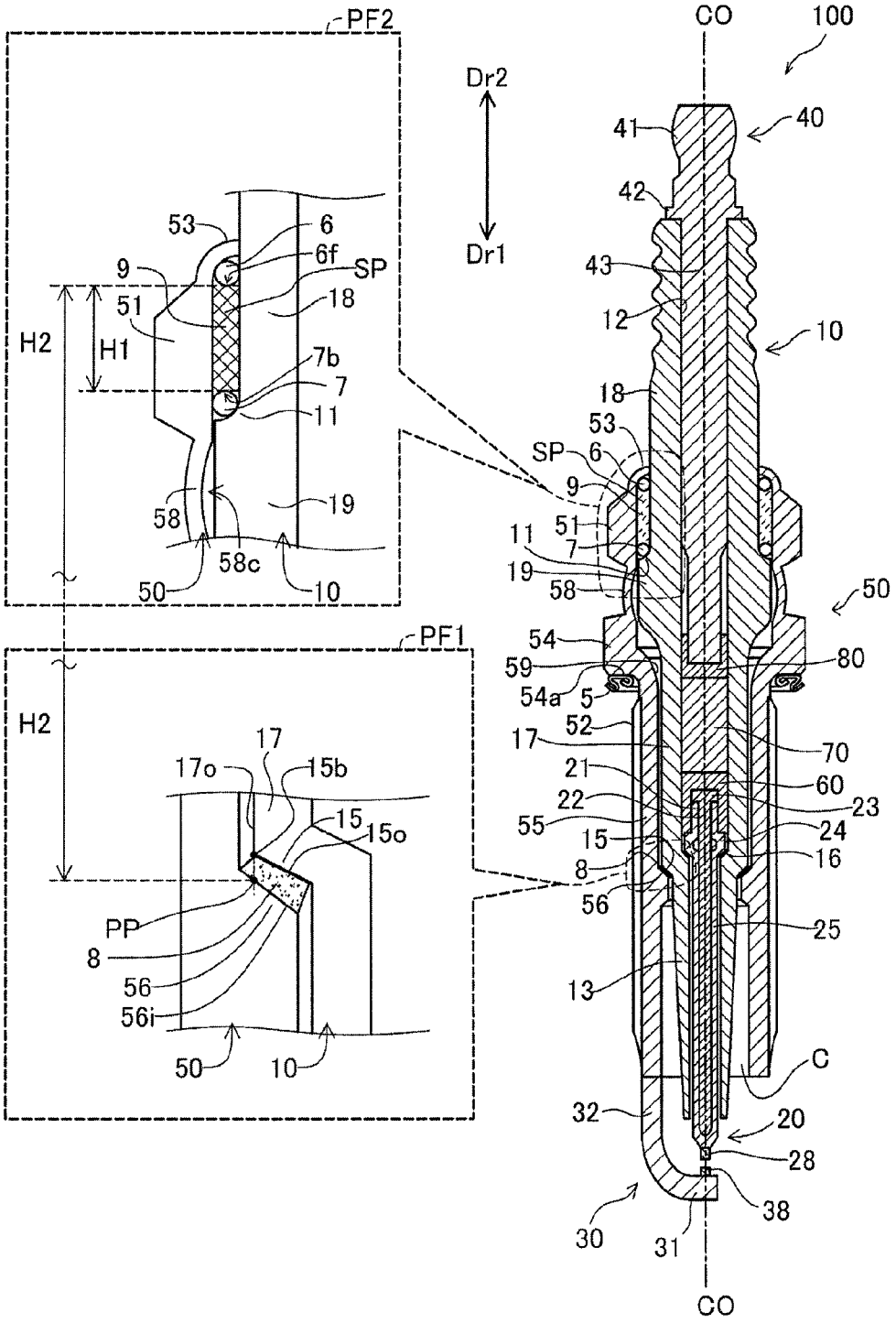
FIG. 1 is a sectional view of a spark plug 100.

A first embodiment of the present invention will next be described. FIG. 1 is a sectional view of a spark plug 100 of the present embodiment. The dot-dash line in FIG. 1 indicates a center axis CO of the spark plug 100. The center axis CO may also be called the axial line CO. A direction (a vertical direction in FIG. 1) in parallel with the center axis CO is called the axial direction. A downward direction in FIG. 1 is called a first direction Dr1, and an opposite direction of the first direction Dr1 is called a second direction Dr2. The first direction Dr1 is a direction directed from a portion of the spark plug 100 located externally of a combustion chamber to a portion of the spark plug 100 inserted into the combustion chamber. A side of the spark plug 100 in the first direction Dr1 may be called a "forward side," and a side of the spark plug 100 in the second direction Dr2 may be called a "rear side." Ends of various members in the first direction Dr1 may be called "forward ends," and ends in the second direction Dr2 may be called "rear ends." The spark plug 100 includes a ceramic insulator 10, a center electrode 20, a ground electrode 30, a metal terminal member 40, a metallic shell 50, an electrically conductive seal 60, a resistor 70, an electrically conductive seal 80, a forward packing 8, talc 9 as an example of a cushioning material, a first rear packing 6, and a second rear packing 7.

The ceramic insulator 10 is formed from alumina by firing (a different electrically insulating material may be employed). The ceramic insulator 10 is a substantially cylindrical member having a through hole 12 (axial hole) extending therethrough along the center axis CO. The ceramic insulator 10 includes, sequentially from the forward side to the rear side, a leg portion 13, an insulator first-diameter-reducing-portion 15, a forward trunk portion 17, a collar portion 19, an insulator second-diameter-reducing-portion 11, and a rear trunk portion 18. The collar portion 19 is located substantially at the axial center of the ceramic insulator 10. The forward trunk portion 17 is located forward of the collar portion 19. The forward trunk portion 17 is smaller in outside diameter than the collar portion 19. The forward trunk portion 17 has an inside diameter reducing portion 16 at its intermediate position. The inside diameter of the inside diameter reducing portion 16 reduces forward. The insulator first-diameter-reducing-portion 15 is located forward of the forward trunk portion 17. The outside diameter of the insulator first-diameter-reducing-portion 15 reduces forward linearly with axial position. That is, in a plane section which contains the center axis CO, an outer circumferential surface 15*o* of the insulator first-diameter-reducing-portion 15 assumes the form of a straight line. The leg portion 13 is located forward of the insulator first-diameter-reducing-portion 15. In a state in which the spark plug 100 is mounted to an internal combustion engine (not shown), the leg portion 13 is exposed to a combustion chamber. The insulator second-diameter-reducing-portion 11 is located rearward of the insulator first-diameter-reducing-portion 15 (more specifically, rearward of the collar portion 19). The outside diameter of the insulator second-diameter-reducing-portion 11 reduces rearward in such a manner as to follow a curve with an axial position such that a change in the outside diameter reduces with distance from the collar portion 19. That is, in a plane section which contains the center axis CO, the outer circumferential surface of the insulator second-diameter-reducing-portion 11 assumes the form of a curve. The rear trunk portion 18 is located rearward of the insulator second-diameter-reducing-portion 11. The rear trunk portion 18 is smaller in outside diameter than the collar portion 19.

The center electrode 20 is inserted into a forward portion of the through hole 12 of the ceramic insulator 10. The center electrode 20 is a rodlike member extending along the center axis CO. The center electrode 20 includes an electrode base metal 21 and a core 22 embedded in the electrode base metal 21. The electrode base metal 21 is, for example, an alloy which contains nickel. The core 22 is of, for example, an alloy which contains copper. A rear portion of the center electrode 20 is disposed within the through hole 12 of the ceramic insulator 10, and a forward end portion of the center electrode 20 protrudes forward from the ceramic insulator 10.

The center electrode 20 has a collar portion 24 protruding radially outward. The collar portion 24 is in contact with the inside diameter reducing portion 16 of the ceramic insulator 10, thereby specifying the axial position of the center electrode 20 in relation to the ceramic insulator 10. An electrode tip 28 is joined to the forward end of the center electrode 20 by, for example, laser welding. The electrode tip 28 is formed of an alloy which contains a noble metal tip having high melting point (e.g., iridium).

The metal terminal member 40 is inserted into a rear portion of the through hole 12 of the ceramic insulator 10. The metal terminal member 40 is a rodlike member extending along the center axis CO. The metal terminal member 40 is formed of low-carbon steel (another electrically conductive metal material can be employed). The metal terminal member 40 includes a collar portion 42 formed at a predetermined axial position, a cap attachment portion 41 located rearward of the collar portion 42, and a leg portion 43 located forward of the collar portion 42. The cap attachment portion 41 protrudes rearward from the ceramic insulator 10. The leg portion 43 is inserted (press-fitted) into the through hole 12 of the ceramic insulator 10.

A resistor 70 is disposed in the through hole 12 of the ceramic insulator 10 between the metal terminal member 40 and the center electrode 20. The resistor 70 reduces radio noise generated when sparks are generated. The resistor 70 is formed of a composition which contains, for example, $B_2O_3$—$SiO_2$ glass powder, $TiO_2$ ceramic powder, and an electrically conductive material such as carbon powder or metal.

In the through hole 12, a gap between the resistor 70 and the center electrode 20 is filled with the electrically conductive seal 60. A gap between the resistor 70 and the metal terminal member 40 is filled with the electrically conductive seal 80. As a result, the center electrode 20 and the metal terminal member 40 are electrically connected through the resistor 70 and the electrically conductive seals 60 and 80. The electrically conductive seals are formed by use of, for example, the above-mentioned various kinds of glass powder and metal powder (Cu, Fe, or the like).

The metallic shell 50 is a cylindrical metal member for fixing the spark plug 100 to the engine head (not shown) of an internal combustion engine. The metallic shell 50 is formed of low-carbon steel (another electrically conductive metal material can be employed). The metallic shell 50 has a through hole 59 extending therethrough along the center axis CO. The ceramic insulator 10 is inserted through the through hole 59 of the metallic shell 50, and the metallic shell 50 is fixed to the outer circumference of the ceramic insulator 10. The metallic shell 50 covers the rear trunk portion 18 of the ceramic insulator 10 and the leg portion 13 over a range from an intermediate position of the rear trunk portion 18 to an intermediate position of the leg portion 13. A forward end portion of the ceramic insulator 10 protrudes from the forward end of the metallic shell 50, and a rear end portion of the ceramic insulator 10 protrudes from the rear end of the metallic shell 50.

The metallic shell 50 includes, sequentially from the forward side to the rear side, a trunk portion 55, a seal portion 54, a deformed portion 58, a tool engagement portion 51, and a crimped portion 53. The seal portion 54 has a substantially circular columnar shape. The trunk portion 55 is located forward of the seal portion 54. The trunk portion 55 is smaller in outside diameter than the seal portion 54. The trunk portion 55 has a threaded portion 52 formed on its outer circumferential surface and adapted to be threadingly engaged with a mounting hole of an internal combustion engine. The threaded portion 52 has a nominal diameter of 10 mm (so-called M10). An annular gasket 5 formed by bending a metal plate is fitted to the metallic shell 50 between the seal portion 54 and the threaded portion 52. The gasket 5 seals a clearance between the spark plug 100 and the internal combustion engine (engine head).

The trunk portion 55 of the metallic shell 50 has an inside diameter reducing portion 56. The inside diameter reducing portion 56 is disposed forward of the collar portion 19 of the ceramic insulator 10. The inside diameter of the inside diameter reducing portion 56 reduces forward linearly with axial position. That is, in a plane section which contains the center axis CO, an inner circumferential surface 56*i* of the inside diameter reducing portion 56 assumes the form of a straight line. The forward packing 8 is held between the inside diameter reducing portion 56 of the metallic shell 50 and the insulator first-diameter-reducing-portion 15 of the ceramic insulator 10. The forward packing 8 is formed by punching out an O-ring-shaped piece from an iron sheet (another material (e.g., copper) can be employed).

The deformed portion 58 is located rearward of the seal portion 54 and has a wall thickness smaller than that of the seal portion 54. The deformed portion 58 is deformed in such a manner that its central portion protrudes radially outward (away from the center axis CO). The tool engagement portion 51 is located rearward of the deformed portion 58. The tool engagement portion 51 has such a shape as to allow a spark wrench to be engaged therewith (e.g., a hexagonal columnar shape). The crimped portion 53 is located rearward of the tool engagement portion 51 and has a wall thickness smaller than that of the tool engagement portion 51. The crimped portion 53 is disposed rearward of the insulator second-diameter-reducing-portion 11 of the ceramic insulator 10 and forms the rear end of the metallic shell 50. The crimped portion 53 is bent radially inward.

An annular space SP is formed between the inner circumferential surface of that portion of the metallic shell 50 which ranges from the tool engagement portion 51 to the crimped portion 53, and the outer circumferential surface of that portion of the ceramic insulator 10 which ranges from the insulator second-diameter-reducing-portion 11 to an intermediate portion of the rear trunk portion 18. The space SP is located between the crimped portion 53 and the insulator second-diameter-reducing-portion 11 and is surrounded by an inner circumferential surface of the metallic shell 50 and an outer circumferential surface of the ceramic insulator 10. The first rear packing 6 is disposed within the space SP at the rear side, and the second rear packing 7 is disposed within the space SP at the forward side. In the present embodiment, the rear packings 6 and 7 are formed into a C-ring shape from an iron wire (another material can be employed). The first rear packing 6 is disposed in contact with the outer circumferential surface of the rear trunk portion 18 of the ceramic insulator 10 and with the inner circumferential surface of the crimped portion 53 of the metallic shell 50. The second rear packing 7 is disposed in contact with the outer circumferential surface of the insulator second-diameter-reducing-portion 11 of the ceramic insulator 10 and with an inner circumferential surface of the metallic shell 50. A space SPF between the two rear packings 6 and 7 within the space SP is filled with powdered talc 9.

Before a predecessor of the crimped portion 53 is crimped, the predecessor of the crimped portion 53 extends rearward in parallel with the center axis CO. In manufacture of the spark plug 100, before the predecessor of the crimped portion 53 is crimped (before the predecessor of the crimped portion 53 is bent), the second rear packing 7, the talc 9, and the first rear packing 6 are inserted in this order into the space SP. Subsequently, a crimping tool is brought into contact with the predecessor of the crimped portion 53 and with a forward end surface 54*a* of the seal portion 54; then, force is applied to the crimping tool in such a manner as to cramp the metallic shell 50, whereby the predecessor of the crimped portion 53 is bent radially inward while a predecessor of the deformed portion 58 is deformed. As a result, the metallic shell 50 is fixed to the ceramic insulator 10.

As a result of deformation of the crimped portion 53 and the deformed portion 58, the talc 9 is compressed. The compressed talc 9, together with the rear packings 6 and 7, provides a seal between the metallic shell 50 and the ceramic insulator 10. The talc 9 also functions as a cushioning material for absorbing vibration (the talc 9 restrains loosening of the metallic shell 50 fixed to the ceramic insulator 10).

Also, as a result of deformation of the crimped portion 53 and the deformed portion 58, the ceramic insulator 10 is pressed forward in relation to the metallic shell 50. That is, the insulator first-diameter-reducing-portion 15 of the ceramic insulator 10 is pressed toward the inside diameter reducing portion 56 of the metallic shell 50; as a result, the forward packing 8 is pressed between the insulator first-diameter-reducing-portion 15 and the inside diameter reducing portion 56. Thus, the forward packing 8 provides a seal between the metallic shell 50 and the ceramic insulator 10. This restrains outward leakage of gas from inside a combustion chamber of an internal combustion engine through a clearance between the metallic shell 50 and the ceramic insulator 10.

The ground electrode 30 includes an electrode base metal 32 whose one end is welded to the forward end of the metallic shell 50, and an electrode tip 38 welded to a distal end portion 31 of the electrode base metal 32. The electrode base metal 32 is nickel (another metal material can be employed). The distal end portion 31 of the electrode base metal 32 is bent radially inward. The electrode tip 38 is welded to the electrode base metal 32 at such a position as to face the electrode tip 28 of the center electrode 20. The electrode tip 38 is formed of platinum (another metal material can be employed). A spark gap is formed between the two electrode tips 28 and 30.

A-2. Detailed Configuration of Spark Plug

Figure 2:
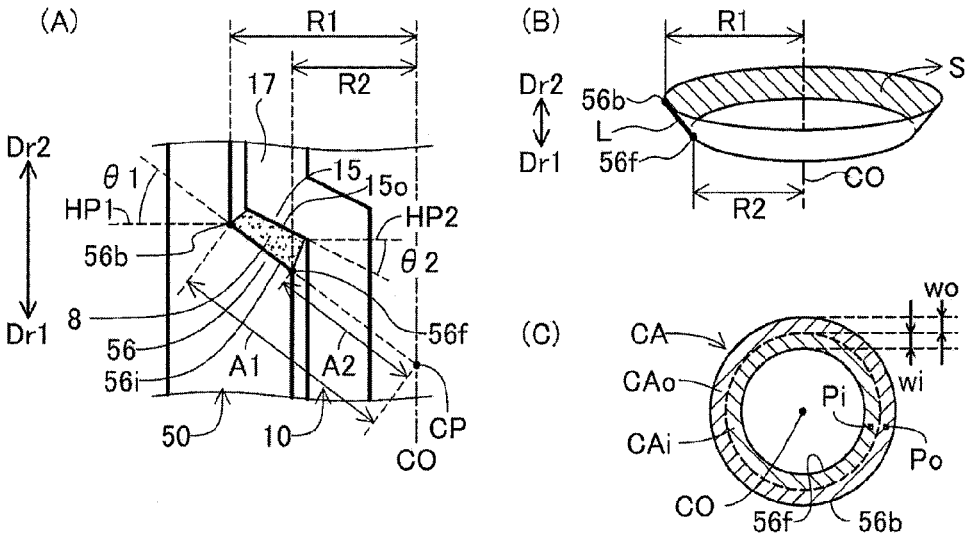
FIG. 2 is a set of explanatory views for explaining the configuration of a forward packing 8 and its periphery.

FIG. 2 is a set of explanatory views for explaining the configuration of the forward packing 8 and its periphery. FIG. 2(A) is an enlarged view showing the forward packing 8 and its periphery. The enlarged view contains parameters θ1, θ2, R1, R2, A1, and A2. The first angle θ1 is an acute angle between the inside diameter reducing portion 56 (inner circumferential surface 56*i*) of the metallic shell 50 and an imaginary plane HP1 perpendicular to the center axis CO. The second angle θ2 is an acute angle between the insulator first-diameter-reducing-portion 15 (outer circumferential surface 150) of the ceramic insulator 10 and an imaginary plane HP2 perpendicular to the center axis CO. These angles θ1 and θ2 are angles in a plane section which contains the center axis CO. The first radius R1 is half of an inside diameter at a rear end 56*b* of the inside diameter reducing portion 56 of the metallic shell 50, and the second radius R2 is half of an inside diameter at a forward end 56*f* of the inside diameter reducing portion 56. In FIG. 2(A), an intersection point CP is an intersection, in the section, between the center axis CO and an extension of the inner circumferential surface 56*i* of the inside diameter reducing portion 56. The first distance A1 indicates a distance between the intersection point CP and the rear end 56*b*, and the second distance A2 indicates a distance between the intersection point CP and the forward end 56*f*.

Force which the inside diameter reducing portion 56 receives in manufacture of the spark plug 100 (in the crimping step) varies with the first angle θ1. In the case of a small first angle θ1, as compared with the case of a large first angle θ1, an angle (acute angle) between the normal to the inner circumferential surface 56*i* of the inside diameter reducing portion 56 and the direction of force applied from the ceramic insulator 10 (identical to the axial direction) is smaller; thus, force which is applied perpendicularly to the inside diameter reducing portion 56 (inner circumferential surface 56*i*) through the forward packing 8; i.e., force which the inside diameter reducing portion 56 (inner circumferential surface 56*i*) receives, becomes large. In the case where the inside diameter reducing portion 56 receives a large force, there can be restrained a deterioration in seal performance caused by insufficient force of gripping the forward packing 8; instead, the possibility of unintentional deformation of the inside diameter reducing portion 56 increases. In the case of occurrence of unintentional deformation of the inside diameter reducing portion 56, there arises the possibility of generation of a clearance between the forward packing 8 and the inside diameter reducing portion 56 (the possibility of a deterioration in seal performance) caused by vibration of an internal combustion engine (i.e., the spark plug 100). By contrast, in the case of a large first angle θ1, since force which the inside diameter reducing portion 56 receives becomes small, the possibility of deformation of the inside diameter reducing portion 56 reduces; instead, there increases the possibility of a deterioration in seal performance caused by insufficient force of gripping the forward packing 8. Also, in the case of a large first angle θ1, since there increases an axial positional shift of the ceramic insulator 10 caused by deformation of the forward packing 8, a manufacturing error of the spark gap may possibly increase. In view of these circumstances, preferably, the first angle θ1 is determined so as to restrain a deterioration in seal performance. A preferred range of the first angle θ1 will be described later.

FIG. 2(B) is a schematic view showing a contact region CA and a contact area S. The contact region CA is where the inside diameter reducing portion 56 of the metallic shell 50 and the forward packing 8 are in contact with each other. In the present embodiment, the contact region CA is the entirety of the inside diameter reducing portion 56 ranging from the rear end 56*b* to the forward end 56*f* of the inside diameter reducing portion 56. The contact area S is the area of the contact region CA. The smaller the contact area S, the higher the pressure applied to the contact region CA; thus, in the case of a small contact area S, there can be restrained a deterioration in seal performance caused by insufficient force of gripping the forward packing 8. By contrast, in the case of a large contact area S, the pressure is low; thus, there can be restrained unintentional deformation of the inside diameter reducing portion 56 or a like problem. In view of these circumstances, preferably, the contact area S is determined so as to restrain a deterioration in seal performance. A preferred range of the contact area S will be described later.

The contact area S is calculated as follows: assuming that a line corresponding to the contact region CA on a section of the spark plug 100 (in the present embodiment, a line L which connects the forward end 56*f* and the rear end 56*b*) goes fully about the center axis CO, an area along the full circumference is calculated. Specifically, the contact area S is calculated according to the calculation formula "$S=\pi*(A1*R1-A2*R2)$." The sign "*" is a multiplication sign (the same also applies in the following description).

Preferably, the first angle θ1 (FIG. 2(A)) is greater than the second angle θ2. This is for the following reason. FIG. 2(C) is a schematic view showing the contact region CA as viewed forward in parallel with the center axis CO. In FIG. 2(C), an inner region CAi indicates a radially inward portion of the contact region CA, and an outer region CAo indicates a radially outer portion of the contact region CA. In FIG. 2(C), a radial width wi of the inner region CAi is identical with a radial width wo of the outer region CAo. An inner partial pressure Pi indicates pressure applied to the inner region CAi, and an outer partial pressure Po indicates pressure applied to the outer region CAo.

In the case where the first angle θ1 is greater than the second angle θ2, a clearance between the inside diameter reducing portion 56 and the insulator first-diameter-reducing-portion 15 reduces radially outward. Therefore, the relational expression "outer partial pressure Po>inner partial pressure Pi" holds. By contrast, in the case where the first angle θ1 is smaller than the second angle θ2, the clearance between the inside diameter reducing portion 56 and the insulator first-diameter-reducing-portion 15 reduces radially inward. Therefore, the relational expression "outer partial pressure Po<inner partial pressure Pi" holds. Meanwhile, the inner region CAi is smaller in area than the outer region CAo. Therefore, a higher pressure (inner partial pressure Pi) in the case of "θ1<θ2 (i.e., Po<Pi)" is higher than a higher pressure (outer partial pressure Po) in the case of "θ1>θ2 (i.e., Po>Pi)." As a result, in the case of "θ1<θ2," the possibility of unintentional deformation of the inside diameter reducing portion 56 becomes higher than in the case of "θ1>θ2." Therefore, in order to reduce the possibility of unintentional deformation of the inside diameter reducing portion 56, preferably, the first angle θ1 is greater than the second angle θ2.

Figure 3:
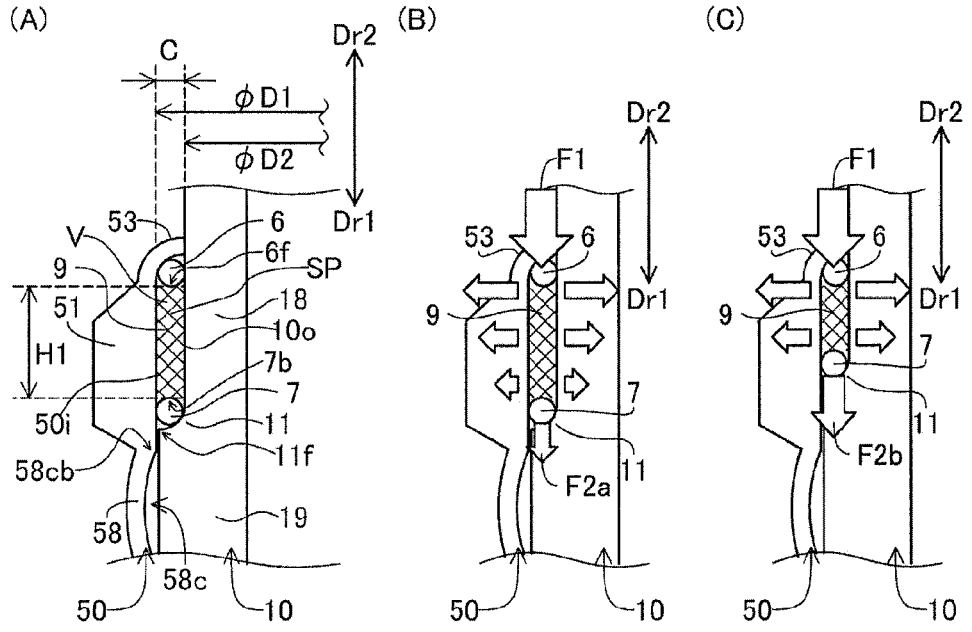
FIG. 3 is a set of schematic views showing the configuration of a crimped portion 53 and its periphery.

FIG. 3 is a set of schematic views showing the configuration of the crimped portion 53 and its periphery. FIG. 3(A) is an enlarged view showing the crimped portion 53 and its periphery. The enlarged view contains parameters H1, C, D1, D2, and V. The first length H1 is a length in parallel with the center axis CO between a forward end 6*f* of the first rear packing 6 and a rear end 7*b* of the second rear packing 7. The first diameter D1 is the inside diameter of that portion of the metallic shell 50 which partially defines the space SP (inside diameter of an inner circumferential surface 50*i* of the metallic shell 50). The second diameter D2 is the outside diameter of that portion of the ceramic insulator 10 which partially defines the space SP (outside diameter of an outer circumferential surface 10*o* of the ceramic insulator 10). The width C is the radial width of the space SP ($C=(D1-D2)/2$). The volume V is the volume of a space having the first length H1 and the width C ($V=R*(D1^2=D2^2)*H1/4$). That is, the volume V is the volume of the space SPF (filled with the talc 9) between the forward end 6*f* of the first rear packing 6 and the rear end 7*b* of the second rear packing 7 within the space SP.

FIGS. 3(B) and 3(C) are explanatory views for explaining force which is applied from the crimped portion 53 to the first rear packing 6, and forces applied to the ceramic insulator 10 and the metallic shell 50. FIG. 3(B) shows the case of a relatively large amount of the talc 9, and FIG. 3(C) shows the case of a relatively small amount of the talc 9. As mentioned above, in manufacture of the spark plug 100 (in the crimping step), the crimped portion 53 applies force in the first direction Dr1 (called the first force F1) to the first rear packing 6. The first rear packing 6 applies force in the first direction Dr1 to the ceramic insulator 10 (insulator second diameter-reducing-portion 11) through the talc 9 and the second rear packing 7. Also, the talc 9 applies radial forces to the metallic shell 50 and the ceramic insulator 10, respectively. Therefore, in the case of a large amount of the talc 9, since force is dispersed, a force F2*a* applied in the first direction Dr1 to the ceramic insulator 10 becomes relatively small (FIG. 3(B)). Particularly, in the case where the first length H1 is long, since the contact area between the talc 9 and other members (the metallic shell 50 and the ceramic insulator 10) is large, the degree of dispersion of force is large. Also, as a result of application of force from the first rear packing 6, talc particles located between the first rear packing 6 and the second rear packing 7 are partially destroyed, and the arrangement of talc particles changes such that a clearance between talc particles is reduced. Thus, in the case where the first length H1 is long, as a result of destruction of talc particles and rearrangement of talc particles, the amount of change (decrease) in the distribution dimension of talc powder in the annular space SP along the center axis CO increases. Therefore, also in this point of view, the force F2*a* applied in the first direction Dr1 to the ceramic insulator 10 becomes relatively small. The same also applies to a dimensional change in the radial direction. In the case of a relatively small amount of the talc 9, since dispersion of force is restrained, a force F2*b* applied in the first direction Dr1 to the ceramic insulator 10 becomes relatively large (FIG. 3(C)). Particularly, in the case where the first length H1 is short, since the contact area between the talc 9 and other members (the metallic shell 50 and the ceramic insulator 10) is small, the degree of dispersion of force is small. Also, in the case where the first length H1 is short, since the amount of talc particles located between the first rear packing 6 and the second rear packing 7 becomes small, there becomes small the amount of change in the distribution dimension along the center axis CO of talc powder in the space SP, which change is caused by destruction of talc particles and rearrangement of talc particles. Therefore, also in this point of view, the force F2*b* applied in the first direction Dr1 to the ceramic insulator 10 becomes relatively large. Therefore, in the case where the amount of the talc 9 is small, there can be restrained a deterioration in seal performance caused by insufficient force of gripping the forward packing 8 (FIG. 1). In the case where the amount of the talc 9 is large, since the capability of vibration absorption by the talc 9 improves, a deterioration in seal performance caused by vibration can be restrained. Preferably, the amount of the talc 9 (e.g., first length H1, width C, and volume V) is determined in view of the above circumstances. Preferred ranges of these parameters H1, C, and V will be described later.

FIG. 1 further shows enlarged fragmentary views PF1 and PF2 of the spark plug 100, and a second length H2. The first enlarged fragmentary view PF1 shows the forward packing 8 and its periphery, and the second enlarged fragmentary view PF2 shows the talc 9 and its periphery. The second length H2 is a length between a forward support position and a rear support position at which the metallic shell 50 supports the ceramic insulator 10. The forward support position is a projection position PP on the inner circumferential surface 56*i* of the metallic shell diameter-reducing-portion 56 of the metallic shell 50 at the time when a rear end 15*b* (a position from which the outside diameter begins to reduce) of the insulator first-diameter-reducing-portion 15 of the insulator 10 is projected in parallel with the axial line CO onto the inner circumferential surface 56*i* of the metallic shell diameter-reducing-portion 56. The rear support position is the rear end of the filler space SPF filled with the talc 9 (the forward end 6*f* of the first rear packing 6). The second length H2 is a length in parallel with the center axis CO between the forward end 6*f* and the projection position PP. As the ratio of the first length H1 to the second length H2 increases, the capability of vibration absorption by the talc 9 improves, so that a deterioration in seal performance caused by vibration can be restrained. However, as mentioned above, in order to restrain a deterioration in seal performance caused by insufficient force of gripping the forward packing 8, preferably, the first length H1 is short. Preferably, the ratio of the first length H1 to the second length H2 (H1/H2) is determined in view of these circumstances, so as to restrain a deterioration in seal performance. The preferred range of the ratio (H1/H2) will be described later.

In the spark plug 100 described above, the forward packing 8 corresponds to the "seal member" appearing in "MEANS FOR SOLVING THE PROBLEM." The forward trunk portion 17 corresponds to the "first portion." The leg portion 13 corresponds to the "second portion." A portion which extends forward from the inside diameter reducing portion 56 and protrudes radially inward (see FIG. 1) corresponds to the "protrusion." The inside diameter reducing portion 56 corresponds to the "metallic shell diameter-reducing-portion."

A-3. Performance Evaluation Test

Next, the results of five performance evaluation tests (first packing airtightness evaluation test, deformation evaluation test, second packing airtightness evaluation test, overall airtightness evaluation test, and ratio evaluation test) will be described.

A-3-1. First Packing Airtightness Evaluation Test

The first packing airtightness evaluation test evaluates airtightness of the forward packing 8 (hereinafter, called "packing airtightness"). There were fabricated a plurality of samples of the spark plug 100 of the first embodiment described above which differed in the parameters S, R1, R2, 01, A1, and A2. The samples were subjected to the evaluation test. Table 1 below shows the parameters of 30 samples #1 to #30.

TABLE 1

| Sample | St ($mm^2$) | S ($mm^2$) | R1 (mm) | R2 (mm) | θ1 (degrees) | Al (mm) | A2 (mm) |
|---|---|---|---|---|---|---|---|
| #01 | 10 | 10.4 | 3.25 | 2.750 | 25 | 3.6 | 3.0 |
| #02 | 10 | 10.1 | 3.25 | 2.775 | 27 | 3.6 | 3.1 |
| #03 | 10 | 9.9 | 3.25 | 2.800 | 30 | 3.8 | 3.2 |
| #04 | 10 | 9.9 | 3.25 | 2.825 | 35 | 4.0 | 3.4 |
| #05 | 10 | 10.0 | 3.25 | 2.850 | 40 | 4.2 | 3.7 |
| #06 | 10 | 9.8 | 3.25 | 2.925 | 50 | 5.1 | 4.6 |
| #07 | 11 | 11.3 | 3.25 | 2.700 | 25 | 3.6 | 3.0 |
| #08 | 11 | 11.1 | 3.25 | 2.725 | 27 | 3.6 | 3.1 |
| #09 | 11 | 10.9 | 3.25 | 2.750 | 30 | 3.8 | 3.2 |
| #10 | 11 | 11.0 | 3.25 | 2.775 | 35 | 4.0 | 3.4 |
| #11 | 11 | 11.2 | 3.25 | 2.800 | 40 | 4.2 | 3.7 |
| #12 | 11 | 11.2 | 3.25 | 2.875 | 50 | 5.1 | 4.5 |
| #13 | 12 | 12.3 | 3.25 | 2.650 | 25 | 3.6 | 2.9 |
| #14 | 12 | 12.0 | 3.25 | 2.675 | 27 | 3.6 | 3.0 |
| #15 | 12 | 11.9 | 3.25 | 2.700 | 30 | 3.8 | 3.1 |
| #16 | 12 | 12.0 | 3.25 | 2.725 | 35 | 4.0 | 3.3 |
| #17 | 12 | 12.3 | 3.25 | 2.750 | 40 | 4.2 | 3.6 |
| #18 | 12 | 11.9 | 3.25 | 2.850 | 50 | 5.1 | 4.4 |
| #19 | 13 | 13.2 | 3.25 | 2.600 | 25 | 3.6 | 2.9 |
| #20 | 13 | 12.9 | 3.25 | 2.625 | 27 | 3.6 | 2.9 |
| #21 | 13 | 12.8 | 3.25 | 2.650 | 30 | 3.8 | 3.1 |
| #22 | 13 | 13.1 | 3.25 | 2.675 | 35 | 4.0 | 3.3 |
| #23 | 13 | 12.9 | 3.25 | 2.725 | 40 | 4.2 | 3.6 |
| #24 | 13 | 13.3 | 3.25 | 2.800 | 50 | 5.1 | 4.4 |
| #25 | 14 | 14.1 | 3.25 | 2.550 | 25 | 3.6 | 2.8 |
| #26 | 14 | 13.9 | 3.25 | 2.575 | 27 | 3.6 | 2.9 |
| #27 | 14 | 13.8 | 3.25 | 2.600 | 30 | 3.8 | 3.0 |
| #28 | 14 | 14.1 | 3.25 | 2.625 | 35 | 4.0 | 3.2 |
| #29 | 14 | 14.0 | 3.25 | 2.675 | 40 | 4.2 | 3.5 |
| #30 | 14 | 14.0 | 3.25 | 2.775 | 50 | 5.1 | 4.3 |

(θ2 = 30 degrees)

A target area St is a target area of the contact region CA, and the contact area S is calculated by the method described above with reference to FIG. 2(B). The contact area S and the target area St may differ to a certain extent for reasons regarding manufacture. The samples have the same members except the metallic shell 50.

Dimensions common to the samples are as follows.

Second angle θ2=30 degrees (FIG. 2(A))

First diameter D1=11.2 mm (FIG. 3(A))

Second diameter D2=9 mm (FIG. 3(A))

Width C=1.1 mm (FIG. 3(A))

First length H1=4.0 mm (FIG. 3(A))

Volume V=140 $mm^3$ (FIG. 3(A))

Second length H2=27.73 mm (FIG. 1)

Figure 4:
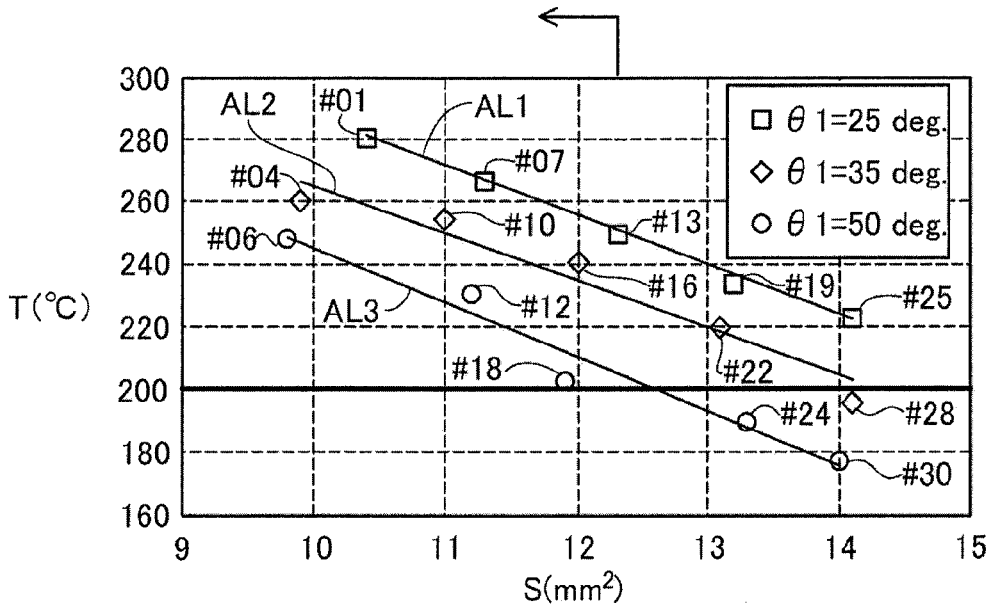
FIG. 4 is a graph showing the results of a first packing airtightness evaluation test.

FIG. 4 is a graph showing the results of the first packing airtightness evaluation test. The horizontal axis indicates the contact area S, and the vertical axis indicates a leak temperature T. The evaluation results of FIG. 4 are of 15 samples having a first angle θ1 of 25 degrees, 35 degrees, and 50 degrees of the samples shown in Table 1. In the graph, signs (including #) attached to data points indicate sample numbers. The graph also shows approximation straight lines AL1, AL2, and AL3 extending along data of a first angle θ1 of 25 degrees, 35 degrees, and 50 degrees, respectively.

The method of the first packing airtightness test is as follows. The seal portion 54 of the spark plug 100 (FIG. 1) is drilled, and the spark plug 100 is mounted to a test bed having a mounting hole similar to that of the cylinder head of an internal combustion engine. Next, a pressure of 2.0 MPa is applied to a forward end portion of the spark plug 100. The flow rate ($cm^3$/min) of air outflowing per unit time from the hole of the seal portion 54 is measured. The flow rate is of air flowing through a clearance between the metallic shell 50 and the ceramic insulator 10 and of air leaking at the forward packing 8. Next, while the flow rate is being measured, the temperature of the seat surface of the test bed is increased. The temperature of the seat surface of the test bed at a flow rate of 10 $cm^3$/min or more is measured as the leak temperature T. The temperature of the seat surface was measured by use of a thermocouple embedded at a depth of about 1 mm below the seat surface of the test bed. When the measured leak temperature T is high, it indicates that a seal provided by the forward packing 8 endures high temperature; therefore, the higher the leak temperature T, the better the seal performance.

As illustrated, with the same first angle θ1, the smaller the contact area S, the higher the leak temperature T. Conceivably, this is for the following reason: as described above with reference to FIG. 2(B), since the smaller the contact area S, the higher the pressure of gripping the forward packing 8, a clearance is less likely to be generated between the forward packing 8 and other members (the metallic shell 50 and the ceramic insulator 10). Also, in the case of substantially the same contact area S, the smaller the first angle θ1, the higher the leak temperature T. Conceivably, this is for the following reason: as described above with reference to FIG. 2(A), since the smaller the first angle θ1, the larger the force of gripping the forward packing 8, a clearance is less likely to be generated between the forward packing 8 and other members (the metallic shell 50 and the ceramic insulator 10).

In view of the temperature of the spark plug 100 mounted to an internal combustion engine, the range of the contact area S with a leak temperature T of 200 degrees centigrade or more is employed as a preferred range. According to the evaluation test results of FIG. 4, when the contact area S is that (12.3 $mm^2$) of sample No. 13, or less, the leak temperature T can be 200 degrees centigrade or more at various values of the first angle θ1 (25 degrees, 35 degrees, and 50 degrees). Therefore, preferably, the contact area S is 12.3 $mm^2$ or less. In the case of a first angle θ1 of 50 degrees (see a straight line accompanied by circles in FIG. 4) which is lowest in the leak temperature T among the cases of the tested three values of the first angle θ1 (25 degrees, 35 degrees, and 50 degrees), when the contact area S is that (11.9 $mm^2$) of sample No. 18, or less, the leak temperature T is 200 degrees centigrade or more. Therefore, particularly preferably, the contact area S is 11.9 $mm^2$ or less.

Of the samples used in the first packing airtightness evaluation test, sample No. 6 has the smallest contact area S (S=9.8 $mm^2$). Although samples having a contact area S of less than 9.8 $mm^2$ have not been tested, conceivably, since force of gripping the forward packing 8 increases further in the case of a contact area S of less than 9.8 $mm^2$, the leak temperature T increases further. Therefore, in view of restraint of lack of force of gripping the forward packing 8, a range of less than 9.8 $mm^2$ can also be employed as a preferred range of the contact area S.

The evaluation results of FIG. 4 indicate that in the case of a contact area S of 9.8 $mm^2$ or more, the leak temperature T can be 200 degrees centigrade or more at various values of the first angle θ1 (25 degrees, 35 degrees, and 50 degrees). Therefore, an area of 9.8 $mm^2$ may be employed as the lower limit of the contact area S. Of the tested values of the contact area S, the smallest values of the contact area S for the tested values of the first angle θ1 are as follows: 10.4 $mm^2$ of sample No. 1 (θ1=25 degrees); 9.9 $mm^2$ of sample No. 4 (θ1=35 degrees); and 9.8 $mm^2$ of sample No. 6 (θ1=50 degrees). Of these values of the contact area S, the largest value of the contact area S (10.4 $mm^2$ of sample No. 1) may be employed as the lower limit of the contact area S.

A-3-2. Deformation Evaluation Test

Figure 5:
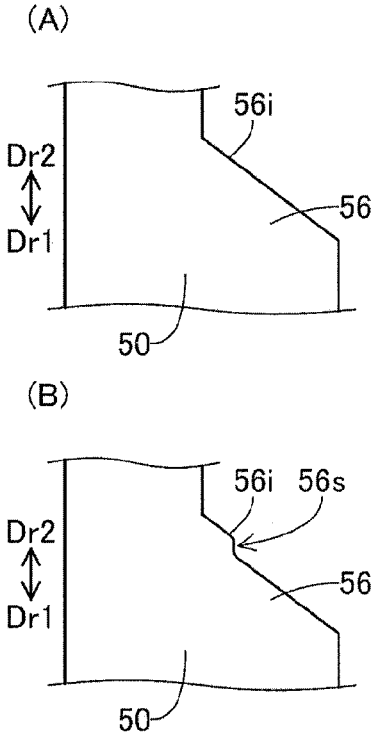
FIG. 5 is a set of schematic views showing the results of a deformation evaluation test.

FIG. 5 is a set of schematic views showing the results of the deformation evaluation test. The deformation evaluation test evaluates whether or not the inner circumferential surface 56*i* of the inside diameter reducing portion 56 of the metallic shell 50 (FIG. 1) is deformed. In this evaluation test, each of the 30 samples shown in Table 1 was cut along a plane which contains the center axis CO, and the condition of the inner circumferential surface 56*i* was examined to evaluate the deformation of the inner circumferential surface 56*i*. FIG. 5(A) shows an example section of a normal inner circumferential surface 56*i* free of deformation, and FIG. 5(B) shows an example section of a deformed inner circumferential surface 56*i*. In the example section of FIG. 5(B), the inner circumferential surface 56*i* has a step 56*s* formed thereon. In the case of the formation of such a step 56*s*, the inner circumferential surface 56*i* is judged to be deformed.

Such a step 56*s* can be formed for various reasons. For example, uneven imposition of pressure on the inner circumferential surface 56*i* of the inside diameter reducing portion 56 can form the step 56*s*. The ceramic insulator 10 presses forward the forward packing 8. Pressure which the inside diameter reducing portion 56 (inner circumferential surface 56*i*) of the metallic shell 50 receives from the forward packing 8 is stronger on the radially inner side with respect to the projection position PP (FIG. 1) than on the radially outer side with respect to the projection position PP. Such uneven imposition of pressure can cause deformation such as the step 56*s*.

FIG. 5(C) is a table showing evaluation results. In the table, the 30 samples are arranged in matrix form according to a combination of the target area St and the first angle θ1. Circle indicates that no deformation is formed, and cross indicates that deformation is formed. As illustrated, in the case of a first angle θ1 of 25 degrees, deformation is formed, but in the case of a first angle θ1 of 27 degrees or more, no deformation is formed. Therefore, in order to restrain deformation of the inside diameter reducing portion 56, preferably, the first angle θ1 is 27 degrees or more.

Also, the evaluation results of FIG. 5 indicate that in the case of a first angle θ1 of 50 degrees or less, the deformation of the inside diameter reducing portion 56 can be restrained at various values of the target area St (i.e., at various values of the contact area S). Therefore, preferably, the first angle θ1 is 50 degrees or less.

A-3-3. Second Packing Airtightness Evaluation Test

The second packing airtightness evaluation test evaluates airtightness of the forward packing 8. There were fabricated a plurality of samples of the spark plug 100 described above which differed in the parameters C, H1, and V. The samples were subjected to the evaluation test. Table 2 shown below shows the parameters of 15 samples #31 to #45.

TABLE 2

| Vt ($mm^3$) | 110 ↓ | 120 ↓ | 140 ↓ | 150 ↓ | 160 ↓ |
|---|---|---|---|---|---|
| Sample | #31 | #32 | #33 | #34 | #35 |
| C (mm) | 1.15 | 1.24 | 1.42 | 1.52 | 1.60 |
| H1 (mm) | 3 | 3 | 3 | 3 | 3 |
| V ($mm^3$) | 110 | 120 | 139 | 151 | 160 |

TABLE 2-continued

| Vt ($mm^3$) | 110 ↓ | 120 ↓ | 140 ↓ | 150 ↓ | 160 ↓ |
|---|---|---|---|---|---|
| Sample | #36 | #37 | #38 | #39 | #40 |
| C (mm) | 0.89 | 0.95 | 1.10 | 1.18 | 1.24 |
| H1(mm) | 4 | 4 | 4 | 4 | 4 |
| V ($mm^3$) | 111 | 119 | 140 | 151 | 160 |
| Sample | #41 | #42 | #43 | #44 | #45 |
| C (mm) | 0.61 | 0.66 | 0.76 | 0.81 | 0.86 |
| H1 (mm) | 6 | 6 | 6 | 6 | 6 |
| V ($mm^3$) | 110 | 120 | 140 | 150 | 160 |

In Table 2, a target volume Vt appears above each column. The target volume Vt is a target value of the volume V described above with reference to FIG. 3(A). As shown in Table 2, some difference may exist between the volume V and the target volume Vt for manufacture-related reasons. The samples have the same outside diameter (second diameter D2 in FIG. 3(A), 9 mm) of the ceramic insulator 10. In order to vary the width C, the samples differ in the inside diameter (first diameter D1) of the metallic shell 50. The samples have the same axial position of the crimped portion 53 and the first rear packing 6. In order to vary the first length H1, the samples differ in the axial position of the insulator second-diameter-reducing-portion 11 of the ceramic insulator 10 (i.e., the axial position of the second rear packing 7). The longer the first length H1, the more the axial position of the insulator second-diameter-reducing-portion 11 (second rear packing 7) shifts forward. As shown in FIG. 3(A), since the deformed portion 58 of the metallic shell 50 is deformed in such a manner as to protrude radially outward, the deformed portion 58 forms a groove 58*c* whose inner circumferential surface is depressed. In order to reduce the possibility of leakage of the talc 9 into the groove 58*c*, a forward end 11*f* of the insulator second-diameter-reducing-portion 11 is located rearward of a rear end 58*cb* of the groove 58*c*. The samples are identical in other configurational features of the spark plug 100.

Dimensions common to the samples are as follows.

Contact area S=11 $mm^2$

First angle θ1=35 degrees

Second angle θ2=30 degrees

Second length H2=27.73 mm

Second diameter D2=9 mm

First diameter D1=Second diameter D2+2*width C

Figure 6:
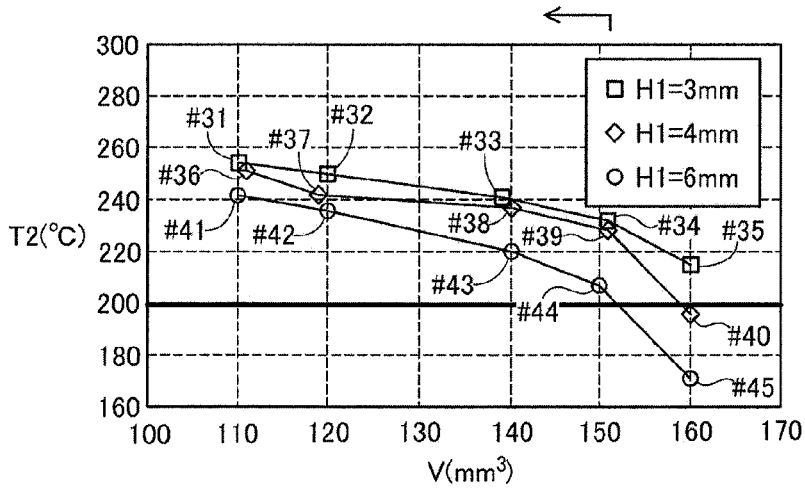
FIG. 6 is a graph showing the results of a second packing airtightness evaluation test.

FIG. 6 is a graph showing the results of the second packing airtightness evaluation test. The horizontal axis indicates the volume V of a space having the first length H1 and the width C (see FIG. 3), and the vertical axis indicates a leak temperature T2. The leak temperature T2 in the second packing airtightness evaluation test is of the seat surface of the test bed at a flow rate of leaking air of 5 $cm^3$/min or more (in the first packing airtightness evaluation test whose results are shown in FIG. 4, the reference flow rate is 10 $cm^3$/min). In this manner, in the second packing airtightness evaluation test, the reference flow rate of leaking air is reduced (rendered severer) as compared with the first packing airtightness evaluation test, for evaluating airtightness. The method of measuring the leak temperature T2 in the second packing airtightness evaluation test is similar to that of measuring the leak temperature T in the first packing airtightness evaluation test except for the employed reference flow rate. In the graph, signs (including #) attached to data points indicate sample numbers. As illustrated, with the same first length H1, the smaller the volume V, the higher the leak temperature T2. Conceivably, this is for the following reason: as described above with reference to FIG. 3, since the smaller the volume V, the more the dispersion of force propagated through the talc 9, force of gripping the forward packing 8 (FIG. 1) increases. With substantially the same volume V, the shorter the first length H1, the higher the leak temperature T2. Conceivably, this is for the following reason: as described above with reference to FIG. 3, since the shorter the first length H1, the more the dispersion of force propagated through the talc 9, force of gripping the forward packing 8 (FIG. 1) increases.

The range of the volume V with a leak temperature T2 of 200 degrees centigrade or more is employed as a preferred range. According to the evaluation test results of FIG. 6, when the volume V is that (151 $mm^3$) of sample Nos. 34 and 39, or less, the leak temperature T2 can be 200 degrees centigrade or more at various values of the first length H1 (3 mm, 4 mm, and 6 mm). Therefore, preferably, the volume V is 151 $mm^3$ or less. In the case of a first length H1 of 6 mm (see a straight line accompanied by circles in FIG. 6) which is lowest in the leak temperature T2 among the cases of the tested three values of the first length H1 (3 mm, 4 mm, and 6 mm), when the volume V is that (150 $mm^3$) of sample No. 44, or less, the leak temperature T2 is 200 degrees centigrade or more. Therefore, particularly preferably, the volume V is 150 $mm^3$ or less.

Of the samples used in the second packing airtightness evaluation test, sample Nos. 31 and 41 have the smallest volume V (V=110 $mm^3$). Although samples having a volume V of less than 110 $mm^3$ have not been tested, conceivably, since the dispersion of force in the talc 9 further reduces in the case of a volume V of less than 110 $mm^3$, force of gripping the forward packing 8 increases further; thus, the leak temperature T2 increases further. Therefore, conceivably, in view of restraint of lack of force of gripping the forward packing 8, a range of less than 110 $mm^3$ can also be employed as a preferred range for the volume V.

The evaluation results of FIG. 6 indicate that when the volume V is 110 $mm^3$ or more, the leak temperature T2 can be 200 degrees centigrade or more at various values of the first length H1 (3 mm, 4 mm, and 6 mm). Therefore, a volume of 110 $mm^3$ may be employed as the lower limit of the volume V. Of the tested values of the volume V, the smallest values of the volume V for the tested values of the first length H1 are as follows: 110 $mm^3$ of sample No. 31 (H1=3 mm); 111 $mm^3$ of sample No. 36 (H1=4 mm); and 110 $mm^3$ of sample No. 41 (H1=6 mm). Of these values of the volume V, the largest value of the volume V (111 $mm^3$ of sample No. 36) may be employed as the lower limit of the volume V.

A-3-4. Overall Airtightness Evaluation Test

Figure 7:
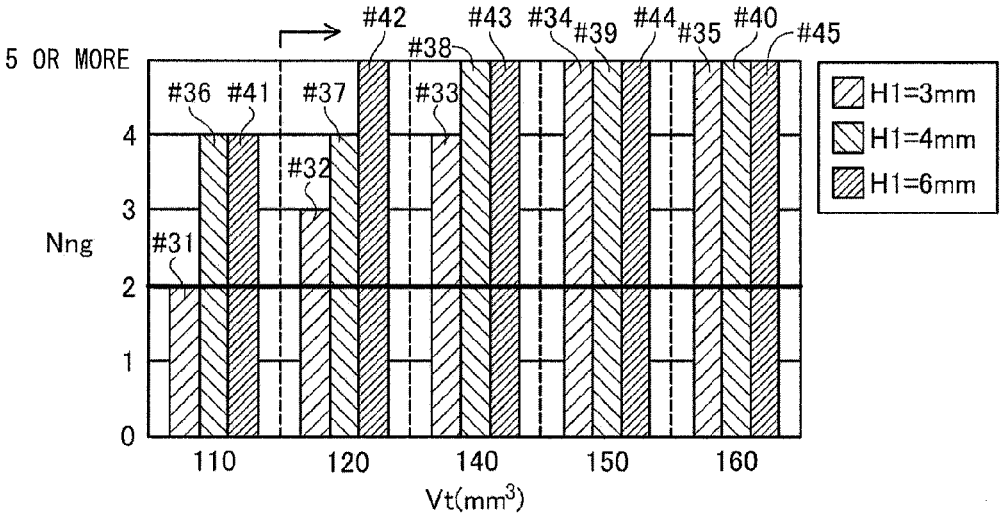
FIG. 7 is a graph showing the results of an overall airtightness evaluation test.

FIG. 7 is a graph showing the results of the overall airtightness evaluation test. Overall airtightness means that of the spark plug 100. In the overall airtightness evaluation test, a vibration test is repeatedly performed on the spark plug 100, and airtightness is evaluated by the number of repeated times of the vibration test (hereinafter, called the "leakage vibration count") at the time when air leakage is observed. The horizontal axis indicates a target volume Vt, and the vertical axis indicates a leakage vibration count Nng. This evaluation test used 15 samples shown in Table 2. In the graph, signs (including #) attached to data points indicate sample numbers. A vibration test method and a method of checking air leakage are those specified in "ISO11565." Specifically, a single time of execution of the vibration test is as follows: after the samples of the spark plug 100 are attached to a predetermined test bed, vibration is applied for 8 hours in each of the axial direction of the samples and a direction orthogonal to the axial direction at a vibration frequency of 50 Hz to 500 Hz, a sweep rate of one octave/min, and an acceleration of 30 g (294 m/s$^2$). The method of checking air leakage is as follows. In a state in which the spark plug 100 has a temperature (a temperature of the seat surface of the test bed) of 200 degrees centigrade, a pressure of 2.0 MPa is applied to the forward side of the spark plug 100 for five minutes, and the amount of air leakage per unit time from the entire spark plug 100 is measured. A leakage rate of 2 cm$^3$/min or less is judged free of air leakage. A leakage rate in excess of 2 cm$^3$/min is judged indicative of air leakage.

According to "ISO11565" regulations, no air leakage must be observed after a single time of execution of the vibration test. The present evaluation test is severer in criteria than ISO; specifically, no air leakage must be observed after two times of execution of the vibration test. That is, a criterion for no leakage was a leakage vibration count Nng of 3 or more. The vibration test was conducted a maximum of five times.

As illustrated, in the case of a target volume Vt of 110 mm$^3$, one sample having a first length H1 of 3 mm (sample No. 31) fails to satisfy the criterion for the leakage vibration count Nng (the sample's Nng=2). In the case of a target volume Vt of 120 mm$^3$ or more, all of the samples satisfy the criterion for the leakage vibration count Nng (the samples' Nng=3 or more). Of three samples having a target volume Vt of 120 mm$^3$ (sample Nos. 32, 37, and 42), sample No. 37 has the smallest volume V; specifically, 119 mm$^3$. The test results of FIG. 7 indicate that samples having a volume V of 119 mm$^3$ or more can satisfy the criterion for the leakage vibration count Nng at various values of the first length H1 (3 mm, 4 mm, and 6 mm). Therefore, preferably, the volume V is 119 mm$^3$ or more. Of three samples having a target volume Vt of 120 mm$^3$ (sample Nos. 32, 37, and 42), sample Nos. 32 and 42 have the largest volume V; specifically, 120 mm$^3$. Therefore, particularly preferably, the volume V is 120 mm$^3$ or more.

From the evaluation results of FIGS. 6 and 7, a range of 119 mm$^3$ to 151 mm$^3$ (hereinafter, called the first range) can be employed as a preferred range of the volume V. The samples surrounded by the double line in Table 2 have the volume V which falls within the first range. Values of the width C and the first length H1 which can be employed are such that the volume V falls within a preferred range (e.g., the first range). Next will be described the upper limits and the lower limits of the width C and the first length H1 which can be derived from the evaluation results of 15 samples in Table 2.

For example, under the condition that the volume V falls within the first range, the smallest value of the first length H1 is 3 mm (sample Nos. 32 to 34). That is, the evaluation results of FIGS. 6 and 7 indicate that, in the case of a first length H1 of 3 mm or more, good seal performance can be implemented through combination with various values of the volume V and the width C. Therefore, a length of 3 mm can be employed as the lower limit of the first length H1.

Under the condition that the volume V falls within the first range, the smallest value of the width C is 0.66 mm (sample No. 42). That is, the evaluation results of FIGS. 6 and 7 indicate that, in the case of a width C of 0.66 mm or more, good seal performance can be implemented through combination with various values of the volume V and the first length H1. Therefore, a width of 0.66 mm can be employed as the lower limit of the width C.

Under the condition that the volume V falls within the first range, the largest value of the first length H1 is 6 mm (sample Nos. 42 to 44). That is, the evaluation results of FIGS. 6 and 7 indicate that, in the case of a first length H1 of 6 mm or less, good seal performance can be implemented through combination with various values of the volume V and the width C. Therefore, a length of 6 mm can be employed as the upper limit of the first length H1.

Under the condition that the volume V falls within the first range, the largest value of the width C is 1.52 mm (sample No. 34). That is, the evaluation results of FIGS. 6 and 7 indicate that, in the case of a width C of 1.52 mm or less, good seal performance can be implemented through combination with various values of the volume V and the first length H1. Therefore, a width of 1.52 mm can be employed as the upper limit of the width C.

A-3-5. Ratio Evaluation Test

The ratio evaluation test evaluates the ratio of the first length H1 to the second length H2 (H1/H2) on the basis of overall airtightness and packing airtightness. Table 3 shown below shows the parameters and evaluation test results of tested six samples (Nos. 46 to 51).

TABLE 3

| Sample | #46 | #47 | #48 | #49 | #50 | #51 |
|---|---|---|---|---|---|---|
| H1/H2 | 0.11 | 0.13 | 0.14 | 0.16 | 0.18 | 0.22 |
| H1 (mm) | 3.0 | 3.5 | 4.0 | 4.5 | 5.0 | 6.0 |
| H2 (mm) | 27.73 | 27.73 | 27.73 | 27.73 | 27.73 | 27.73 |
| Overall airtightness | A | AA | AA | AA | AA | AA |
| Packing airtightness | AA | AA | AA | AA | AA | A |

Table 3 shows the ratio (H1/H2), the first length H1, the second length H2, the evaluation results of overall airtightness, and the evaluation results of packing airtightness. As shown in Table 3, the six samples differ in the first length H1 and have the same value of the second length H2. That is, as in the case of the samples in Table 2, the samples have the same axial position of the crimped portion 53 (FIG. 3(A)) and the first rear packing 6 and differ in the axial position of the insulator second-diameter-reducing portion 11 of the ceramic insulator 10 (i.e., the axial position of the second rear packing 7). The six samples are identical in other configurational features.

Dimensions common to the samples are as follows.

Contact area S=11 mm$^2$

First angle θ1=35 degrees

Second angle θ2=30 degrees

First diameter D1=11.2 mm

Second diameter D2=9 mm

Width C=1.1 mm

The volume V can be calculated by the formula "$V=\pi*(D1^2-D2^2)*H1/4$." The samples have the following values of the volume V: sample No. 46: 105 mm$^3$; sample No. 47: 122 mm$^3$; sample No. 48: 140 mm$^3$; sample No. 49: 157 mm$^3$; sample No. 50: 175 mm$^3$; and sample No. 51: 209 mm$^3$.

The evaluation test for overall airtightness is similar to the evaluation test described above with reference to FIG. 7. Evaluation criteria for overall airtightness shown in Table 3 are as follows:

Single A: The leakage vibration count Nng is 4 or 5 (airtightness is maintained after three times of execution of the vibration test).

Double A: The leakage vibration count Nng is 6 or more (airtightness is maintained after five times of execution of the vibration test).

The evaluation test for packing airtightness is similar to the evaluation test described above with reference to FIG. 4. Evaluation criteria for packing airtightness shown in Table 3 are as follows:

Single A: The leak temperature T is 200 degrees centigrade to less than 220 degrees centigrade.

Double A: The leak temperature T is 220 degrees centigrade or more.

As shown in Table 3, the higher the ratio (H1/H2), the better the overall airtightness. Conceivably, this is for the following reason: the higher the ratio, the larger the amount of the talc 9 (FIG. 1), so that the capability of vibration absorption by the talc 9 improves. Specifically, at a ratio of 0.11, overall airtightness is evaluated as single A, whereas at a ratio of 0.13 or more, overall airtightness is evaluated as double A. Therefore, the ratio is preferably 0.11 or more, particularly preferably, 0.13 or more.

As shown in Table 3, the lower the ratio (H1/H2), the better the packing airtightness. Conceivably, this is for the following reason: the lower the ratio, the smaller the amount of the talc 9 (FIG. 3), so that force of gripping the forward packing 8 (FIG. 1) increases. Specifically, at a ratio of 0.22, packing airtightness is evaluated as single A, whereas at a ratio of 0.18 or less, packing airtightness is evaluated as double A. Therefore, the ratio is preferably 0.22 or less, particularly preferably 0.18 or less.

When the spark plug 100 vibrates, in the vicinity of the talc 9, the relative position between the metallic shell 50 and the ceramic insulator 10 may change. The talc 9 absorbs the relative positional change. The relative positional change arises from the difference in movement between the metallic shell 50 and the ceramic insulator 10 during vibration. Conceivably, in the case where the metallic shell 50 and the ceramic insulator 10 are heavy, one of the metallic shell 50 and the ceramic insulator 10 encounters difficulty in following movement of the other; accordingly, the relative positional change is likely to increase. A large value of the second length H2 indicates that the metallic shell 50 and the ceramic insulator 10 are long; i.e., the metallic shell 50 and the ceramic insulator 10 are heavy. Therefore, the first length H1 suited for absorption of vibration increases with the second length H2. Thus, even in the case where the second length H2 differs from that of the samples in Table 3, in order to implement good overall airtightness and packing airtightness, preferably, the ratio (H1/H2) falls within the above-mentioned range.

The five evaluation tests have been described. Determination of the parameters according to the evaluation tests improves seal performance even through the threaded portion 52 of the spark plug 100 has a small diameter (nominal diameter=M10).

Some of the parameters may be set to outside the preferred ranges mentioned above. According to "ISO11565" regulations, no air leakage must be observed after a single time of execution of the vibration test. Therefore, there may be employed a range of the volume V in which the leakage vibration count Nng is two or more in the evaluation results shown in FIG. 7. For example, the volume V of a sample whose target volume Vt is 110 $mm^3$ (e.g., 110 $mm^3$ of sample Nos. 31 and 41 or 111 $mm^3$ of sample No. 36) may be employed as the lower limit of the volume V. Single A appearing in Table 3, which shows the evaluation results of overall airtightness, indicates that the leakage vibration count Nng is 4 or 5. If a leakage vibration count Nng of 2 or more is employed as an evaluation criterion, a ratio (H1/H2) of less than 0.11 can also be employed.

A-4. Modification of First Embodiment

Shapes of members of the spark plug 100 are not limited to those shown in FIG. 1, but various shapes may be employed for the members. For example, various ring-shaped members (e.g., O-ring) may be employed as the rear packings 6 and 7.

The insulator first-diameter-reducing-portion 15 can assume various shapes whose outlines reduce in size from the rear side toward the forward side. For example, the outline may reduce in size from the rear side toward the forward side in such a manner as to follow a curve with the axial position.

The insulator second-diameter-reducing-portion 11 can assume various shapes whose outlines reduce in size from the forward side toward the rear side. For example, the outline may reduce in size from the forward side toward the rear side in such a manner as to follow a straight line with the axial position.

Figure 8:
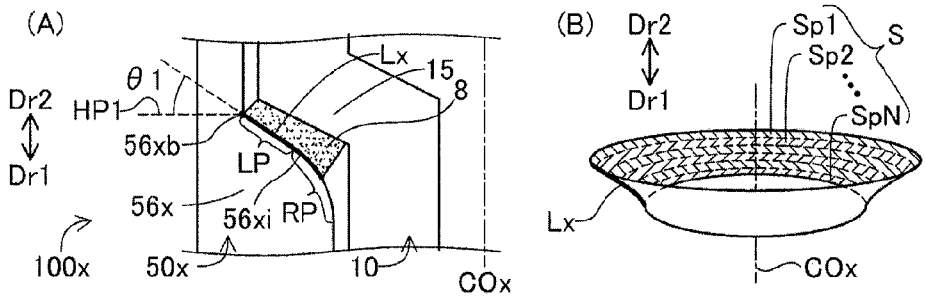
FIG. 8 is a set of explanatory views for explaining the configuration of the forward packing 8 and its periphery.

The inside diameter reducing portion 56 may include a portion which reduces in inside diameter from the rear side toward the forward side in such a manner as to follow a curve with the axial position. FIG. 8 is a set of explanatory views for explaining the configuration of the forward packing 8 and its periphery in a spark plug 100*x* according to the modified embodiment. Similar to FIG. 2(A), FIG. 8(A) shows a fragmentary plane section which contains a center axis COx. The inner circumferential surface 56*xi* of an inside diameter reducing portion 56*x* includes a first portion LP whose inside diameter changes linearly with the axial position, and a second portion RP whose inside diameter changes along a curve with the axial position. Even in such a case, an acute angle between the first portion LP and the imaginary plane HP1 perpendicular to the center axis COx can be employed as the first angle θ1. In the case where the inside diameter reducing portion is formed by use of a drill or a like tool, a portion (hereinafter called the "linear portion") whose inner circumferential surface assumes, in section, the form of a straight line can be formed (particularly, the linear portion is apt to be formed in the vicinity of a rear end 56*xb* of the inside diameter reducing portion 56*x*; i.e., in the vicinity of a position from which the inside diameter begins to reduce). Therefore, an angle which can be specified by use of such a linear portion can be employed as the first angle θ1.

The contact area S can also be calculated as in the case of FIG. 2(B). FIG. 8(B) is a schematic view for calculating the contact area S. A line Lx in FIG. 8(B) corresponds to a contact region between the inside diameter reducing portion 56*x* and the forward packing 8 as shown in FIG. 8(A). The line Lx includes a curve portion (a portion of the second portion RP). Even in such a case, similar to the case of FIG. 2(B), the contact area S can be calculated assuming that the line Lx goes fully about the center axis COx. For example, the line Lx is divided along the axial direction into N equal segments (N is an integer of 2 or greater). Assuming that the N segments are straight lines, a fragmentary area Spi (i=1 to N) corresponding to each of the N segments is calculated similar to the case of FIG. 2(B). The total of the fragmentary area Spi (i=1 to N) is the contact area S.

B. Second Embodiment

Figure 9:
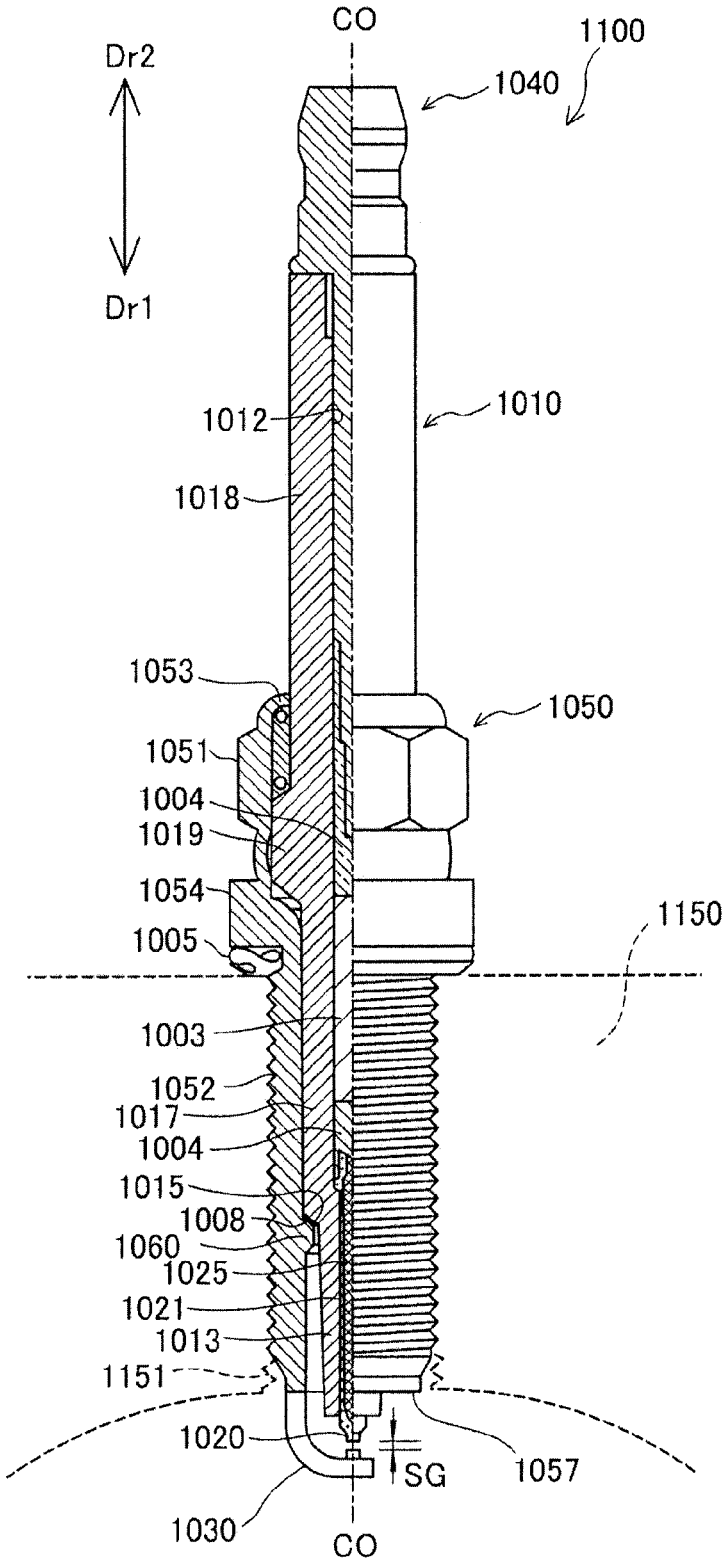
FIG. 9 is a partially sectional view showing a schematic configuration of a spark plug 1100 according to a second embodiment of the present invention.

FIG. 9 is a partially sectional view showing a spark plug 1100 according to a second embodiment of the present invention. FIG. 9 shows a front view of the appearance of the spark plug 1100 at the right side of the axial line CO represented by a dot-dash line, and a sectional view of the spark plug 1100 taken along the center axis of the spark plug 1100 at the left side of the axial line CO. In the following description, the axially lower side (Dr1 side) of the spark plug 1100 is referred to as the forward side of the spark plug 1100, and the axially upper side (Dr2 side) as the rear side. The spark plug 1100 includes a ceramic insulator 1010, a center electrode 1020, a ground electrode 1030, a terminal electrode 1040, and a metallic shell 1050.

The ceramic insulator 1010 is a tubular insulator having an axial hole 1012 which is formed at its center and accommodates therein the center electrode 1020 and the terminal electrode 1040. The axial hole 1012 extends along the axial line CO. The ceramic insulator 1010 is formed from a ceramic material such as alumina by firing. The ceramic insulator 1010 has a center trunk portion 1019 formed at the axial center and having the largest outside diameter in the ceramic insulator 1010. The ceramic insulator 1010 has a rear trunk portion 1018 located rearward of the center trunk portion 1019 and providing electrical insulation between the terminal electrode 1040 and the metallic shell 1050. The ceramic insulator 1010 has a forward trunk portion 1017 located forward of the center trunk portion 1019 and being smaller in outside diameter than the rear trunk portion 1018. The ceramic insulator 1010 has a leg portion 1013 located forward of the forward trunk portion 1017 and having an outside diameter which is smaller than that of the forward trunk portion 1017 and reduces toward the center electrode 1020. The ceramic insulator 1010 has a diameter reducing portion 1015 which is located between and connects the forward trunk portion 1017 and the leg portion 1013 and whose outside diameter reduces forward.

The center electrode 1020 is inserted into the axial hole 1012 of the ceramic insulator 1010. The center electrode 1020 is a rodlike member composed of an electrode base metal 1021 having a closed-bottomed tubular shape and a core 1025 embedded in the electrode base metal 1021 and being superior in thermal conductivity to the electrode base metal 1021. In the present embodiment, the electrode base metal 1021 is a nickel alloy which contains nickel (Ni) as a main component. The core 1025 is formed of copper or an alloy which contains copper as a main component. The center electrode 1020 is held in the axial hole 1012 of the ceramic insulator 1010, and a forward end portion of the center electrode 1020 protrudes outward from the axial hole 1012 (ceramic insulator 1010). The center electrode 1020 is electrically connected to the terminal electrode 1040 through a ceramic resistor 1003 and seal bodies 1004.

The ground electrode 1030 is formed of a metal having high corrosion resistance; for example, a nickel alloy. A proximal end portion of the ground electrode 1030 is welded to a forward end surface 1057 of the metallic shell 1050. A distal end portion of the ground electrode 1030 is bent toward the axial line CO. A spark gap SG is formed between the distal end portion of the ground electrode 1030 and the forward end surface of the center electrode 1020, and spark discharges are generated across the spark gap SG.

The terminal electrode 1040 is provided at a rear side of the axial hole 1012, and a rear end portion of the terminal electrode 1040 protrudes from the rear end of the ceramic insulator 1010. A high-voltage cable (not shown) is connected to the terminal electrode 1040 through a plug cap (not shown), and a high voltage is applied to the terminal electrode 1040.

The metallic shell 1050 is a cylindrical metal member which holds the ceramic insulator 1010 while circumferentially surrounding a portion of the ceramic insulator 1010 ranging from a portion of the rear trunk portion 1018 to the leg portion 1013. The metallic shell 1050 is formed of low-carbon steel and is entirely plated with nickel, zinc, etc. The metallic shell 1050 includes a tool engagement portion 1051, a mounting threaded portion 1052, a crimped portion 1053, and a seal portion 1054. These portions are disposed, from the rear side toward the forward side, in the order of the crimped portion 1053, the tool engagement portion 1051, the seal portion 1054, and the mounting threaded portion 1052. The tool engagement portion 1051 allows a tool to be engaged therewith for mounting the spark plug 1100 to an engine head 1150 of an internal combustion engine. The mounting threaded portion 1052 has a thread which engages with a mounting threaded hole 1151 of the engine head 1150.

The metallic shell 1050 has a protrusion 1060 located on the radially inner side of the mounting threaded portion 1052 and protruding radially inward. The protrusion 1060 is located at such a position as to face the diameter reducing portion 1015 of the ceramic insulator 1010 and a rear end portion of the leg portion 1013. A packing 1008, which is an annular seal member, is provided between the protrusion 1060 and the diameter reducing portion 1015 of the ceramic insulator 1010. The packing 1008 is in contact with the protrusion 1060 and with the diameter reducing portion 1015 and provides a seal between the ceramic insulator 1010 and the metallic shell 1050. The packing 1008 can be formed of a cold-rolled steel sheet.

The crimped portion 1053 is a thin-walled rear end portion of the metallic shell 1050 and is provided for the metallic shell 1050 to hold the ceramic insulator 1010. Specifically, in manufacture of the spark plug 1100, a predecessor of the crimped portion 1053 is bent inward for applying force forward, whereby the ceramic insulator 1010 is unitarily held to the metallic shell 1050 in a state in which a forward end portion of the center electrode 1020 protrudes from the forward end of the metallic shell 1050. The seal portion 1054 is formed in a collar shape at the rear end of the mounting threaded portion 1052. An annular gasket 1005 is formed by bending a sheet piece and is fitted to the metallic shell 1050 between the seal portion 1054 and the engine head. The spark plug 1100 is mounted to the mounting threaded hole 1151 of the engine head 1150 through the metallic shell 1050.

Figure 10:
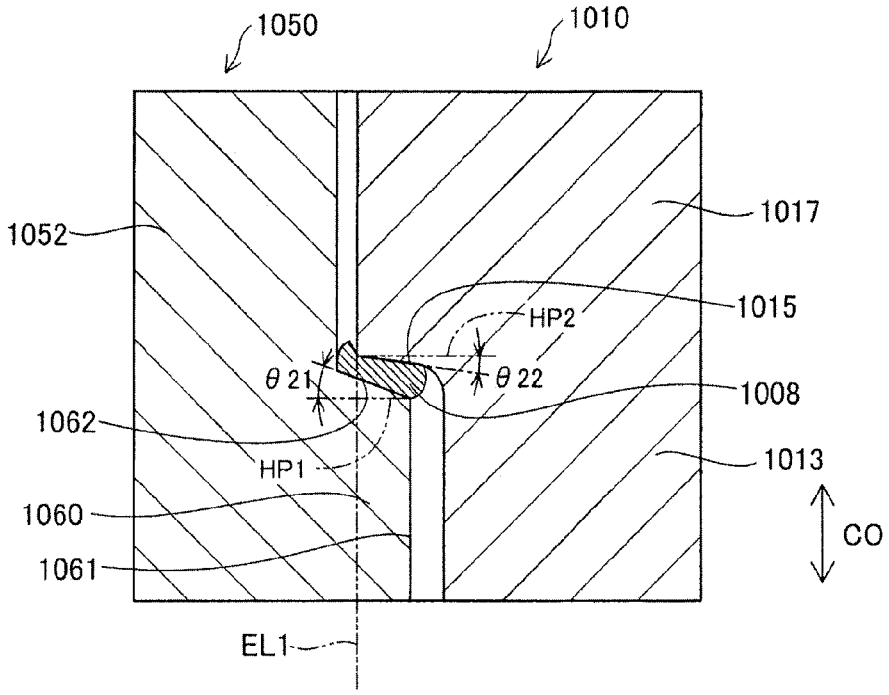
FIG. 10 is an enlarged sectional view showing a packing 1008 and its periphery of the spark plug 1100.

FIG. 10 is an enlarged sectional view showing the packing 1008 and its periphery of the spark plug 1100 shown in FIG. 9. The protrusion 1060 of the metallic shell 1050 has a top portion 1061 having a fixed diameter, and a diameter reducing portion 1062 whose inside diameter reduces forward. The top portion 1061 is smallest in inside diameter in the protrusion 1060. The diameter reducing portion 1062 is a portion of the protrusion 1060 located rearward of the top portion 1061. The diameter reducing portion 1062 is formed at such a position as to face the diameter reducing portion 1015 of the ceramic insulator 1010.

The packing 1008 is disposed between the diameter reducing portion 1015 of the ceramic insulator 1010 and the diameter reducing portion 1062 of the metallic shell 1050. The packing 1008 is disposed at such a position as to cross an extension line EL1 formed by imaginarily extending, in the axially forward direction, the outer surface of the forward trunk portion 1017 of the ceramic insulator 1010. In the present embodiment, the packing 1008 is disposed in such a manner as to be in contact with the entire surface of the diameter reducing portion 1062.

In the section shown in FIG. 10, an angle θ22 is an acute angle between a plane HP2 (represented by the straight line in the sectional view of FIG. 10) orthogonal to the axial line CO and the outline of the diameter reducing portion 1015 of the ceramic insulator 1010 ($0° < \theta 22 < 90°$). An angle θ21 is an acute angle between a plane HP1 (represented by the straight line in the sectional view of FIG. 10) orthogonal to the axial line CO and the outline of the diameter reducing portion 1062 of the metallic shell 1050 ($0° < \theta 21 < 90°$). FIG. 2 showing the first embodiment and FIG. 10 showing the second embodiment differ in the axial positions of the planes HP1 and HP2. However, in determining the angle θ21 of the diameter reducing portion 1062 of the metallic shell 1050 and the angle θ22 of the diameter reducing portion 1015 of the ceramic insulator 1010, the axial positions of the planes HP1 and HP2 can be set arbitrarily. At this time, the spark plug 1100 of the present embodiment satisfies the following relational expression (1). That is, the outline of the diameter reducing portion 1062 is greater than the outline of the diameter reducing portion 1015 in inclination from a direction orthogonal to the axial line CO (herein, may be referred to merely as the orthogonal direction). In the case where the outline of the diameter reducing portion 1015 includes a curve; for example, in the case where the connection between the forward trunk portion 1017 and the diameter reducing portion 1015 is chamfered, the angle θ22 is specified by use of a straight segment of the outline of the diameter reducing portion 1015. This also applies to the angle θ21.

$$\theta 21 > \theta 22 \quad (1)$$

The spark plug 1100 of the present embodiment also satisfies the following relational expressions (2) and (3). The relational expressions (2) and (3) represent selective conditions, not mandatory conditions.

$$\theta 22 \geq 30^\circ \quad (2)$$

$$\theta 21 - \theta 22 \leq 7^\circ \quad (3)$$

In the spark plug 1100 described above, the packing 1008 corresponds to the "seal member" appearing in "MEANS FOR SOLVING THE PROBLEM." The ceramic insulator 1010 corresponds to the "insulator." The forward trunk portion 1017 corresponds to the "first portion." The leg portion 1013 corresponds to the "second portion." The diameter reducing portion 1015 corresponds to the "insulator first-diameter-reducing-portion." The diameter reducing portion 1062 corresponds to the "metallic shell diameter-reducing-portion."

Figure 11:
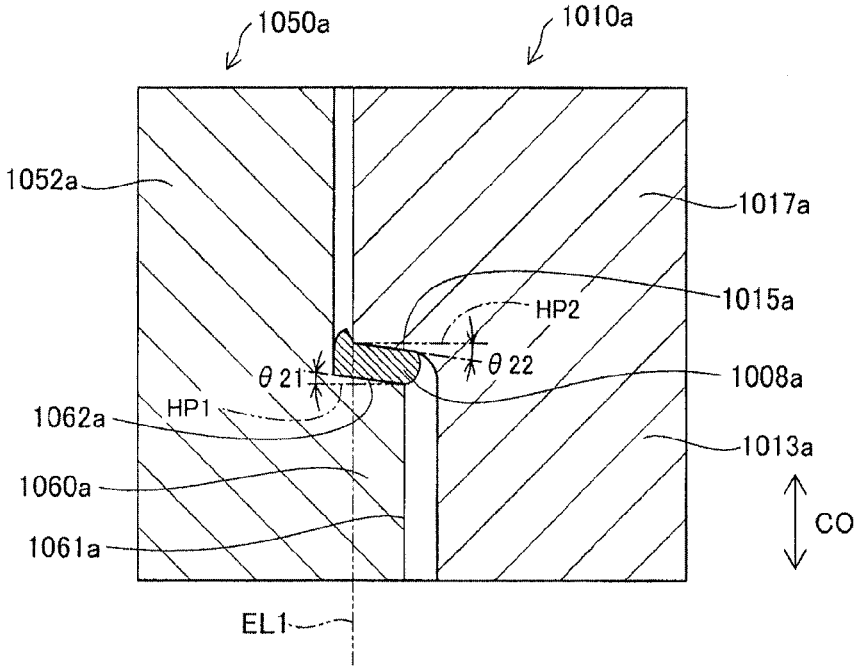
FIG. 11 is an enlarged sectional view showing a packing 1008*a* and its periphery of a spark plug 1100*a* of Comparative Example.

FIG. 11 is an enlarged sectional view showing a packing 1008*a* and its periphery of a spark plug 1100*a* of Comparative Example. In FIG. 11, component members of the spark plug 1100*a* are denoted by reference numerals assigned to corresponding component members of the spark plug 1100 (see FIG. 10) with suffix "a." The spark plug 1100*a* differs from the spark plug 1100 only in the relation between the angle θ22 and the angle θ21 and is identical to the spark plug 1100 in other configurational features. In the spark plug 1100*a*, the angle θ22 and the angle θ21 satisfy the following relational expression (4). That is, the outline of a diameter reducing portion 1062*a* and the outline of a diameter reducing portion 1015*a* are in parallel with each other.

$$\theta 22 = \theta 21 \quad (4)$$

According to the spark plug 1100*a* of Comparative Example, the diameter reducing portion 1062*a* receives load uniformly throughout the surface thereof from the packing 1008*a*. By contrast, according to the spark plug 1100 of the present embodiment, the angles satisfy the relational expression (1) mentioned above; as a result, load which the diameter reducing portion 1062 receives becomes larger at the outer circumference side of the diameter reducing portion 1062 than at the inner circumference side (side toward the axial line CO). That is, an unbalanced load is imposed on the diameter reducing portion 1062 such that surface pressure applied to the diameter reducing portion 1062 at the outer circumference side increases locally. Therefore, there can be improved seal performance between the ceramic insulator 1010 and the metallic shell 1050. Also, since surface pressure applied to the diameter reducing portion 1062 at the inner circumference side is relatively reduced, there can be restrained deformation of the protrusion 1060 in which the protrusion 1060 projects toward the ceramic insulator 1010 as a result of reception of load from the packing 1008. As a result, the following problem can be restrained: the deformed protrusion 1060 causes an inner circumferential portion of the packing 1008 to be pressed against the ceramic insulator 1010 and thus damages the ceramic insulator 1010.

Also, according to the spark plug 1100, as a result of satisfaction of the relational expression (2) mentioned above, even though the spark plug 1100 mounted to an internal combustion engine receives vibration in a direction orthogonal to the axial direction, improved seal performance can be exhibited. This will be described with reference to FIGS. 12A and 12C.

Figure 12A:
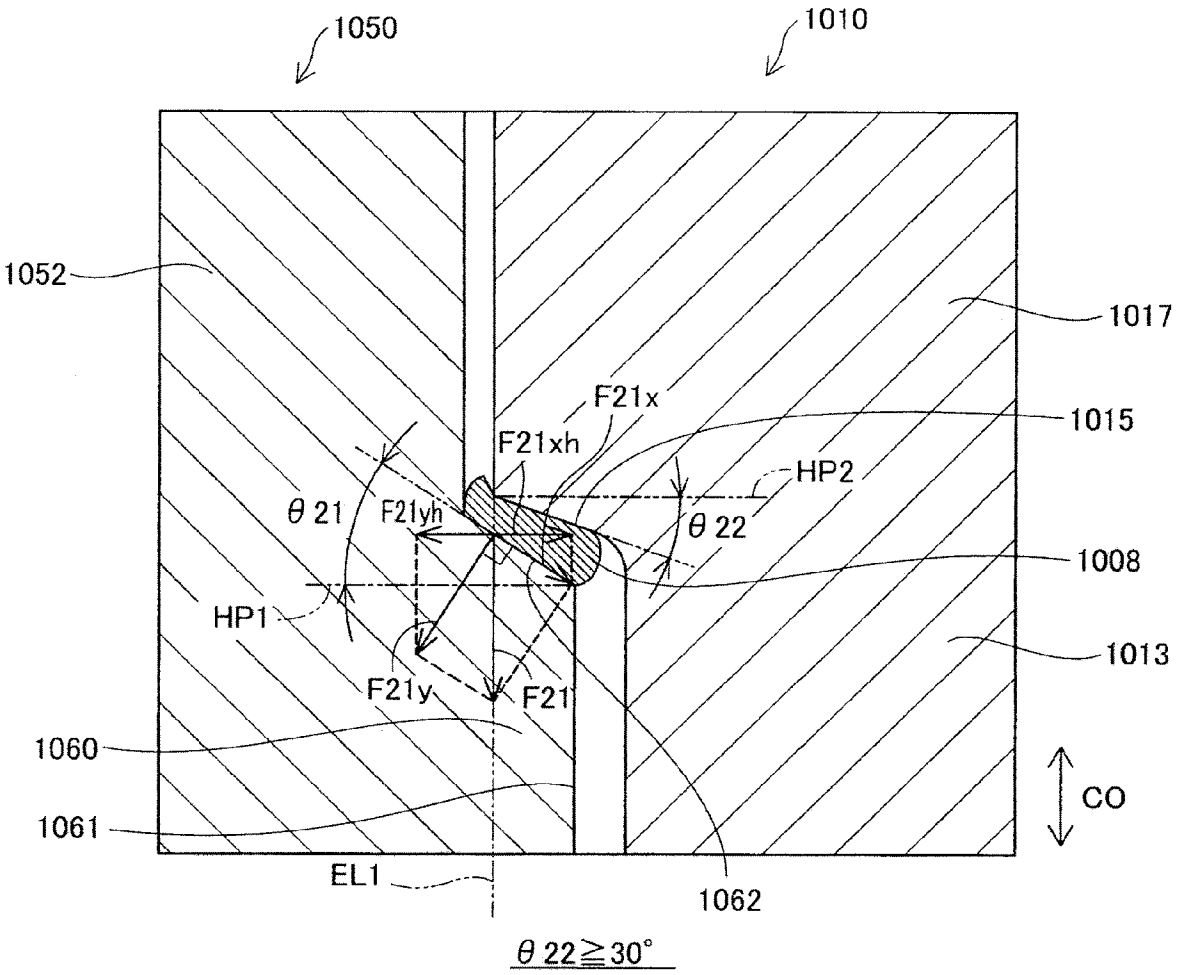
FIG. 12A is an explanatory view showing the direction of load which a diameter reducing portion 1062 receives from a packing 1008.
Figure 12B:
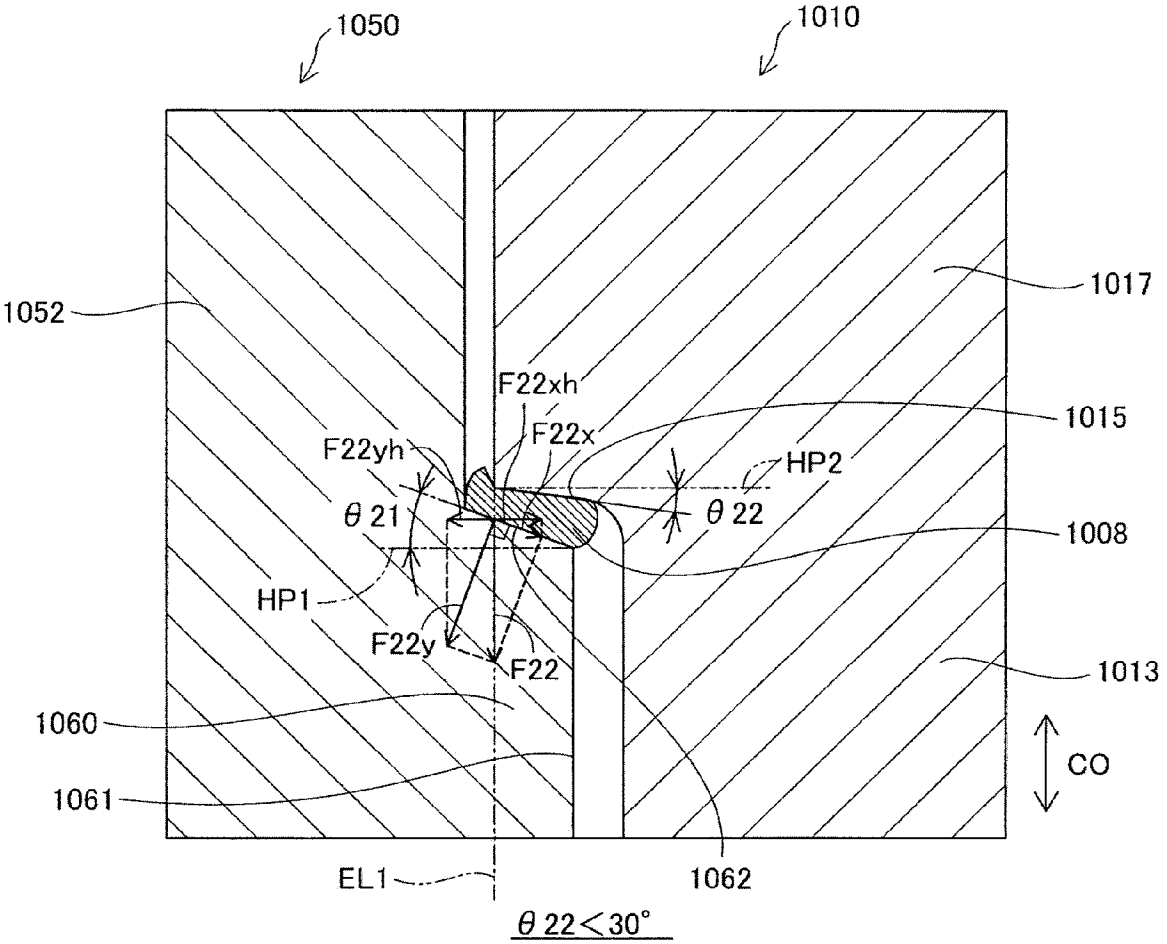
FIG. 12B is an explanatory view showing the direction of load which the diameter reducing portion 1062 receives from the packing 1008.

FIGS. 12A and 12B show the direction of load which the diameter reducing portion 1062 receives from the packing 1008. FIG. 12A shows the case where the relational expression (2) mentioned above is satisfied, and FIG. 12B shows the case where the relational expression (2) is not satisfied. As shown in FIG. 12A, a force F21 along the axial line CO which the diameter reducing portion 1062 receives from the packing 1008 can be decomposed into a force F21*x* along the surface of the diameter reducing portion 1062 and a force F21*y* perpendicular to the surface of the diameter reducing portion 1062. In FIG. 12A, a force F21*xh* is a component orthogonal to the axial line CO of the force F21*x* along the surface of the diameter reducing portion 1062. In FIG. 12A, a force F21*yh* is a component orthogonal to the axial line CO of the force F21*y* orthogonal to the surface of the diameter reducing portion 1062. The force F21*xh* and the force F21*yh* balance with each other.

Similarly, as shown in FIG. 12B, a force F22 along the axial line CO which the diameter reducing portion 1062 receives from the packing 1008 can be decomposed into a force F22*x* along the surface of the diameter reducing portion 1062 and a force F22*y* orthogonal to the surface of the diameter reducing portion 1062. In FIG. 12B, a force F22*xh* is a component orthogonal to the axial line CO of the force F22*x* along the surface of the diameter reducing portion 1062. In FIG. 12B, a force F22*yh* is a component orthogonal to the axial line CO of the force F22*y* orthogonal to the surface of the diameter reducing portion 1062. The force F22*xh* and the force F22*yh* balance with each other.

As is apparent from FIGS. 12A and 12B, the forces F21*xh* and F21*yh* in the spark plug 1100 which satisfies the above relational expression (2) are larger than the forces F22*xh* and F22*yh* in the spark plug 1100 which fails to satisfy the relational expression (2). That is, the spark plug 1100 which satisfies the above relational expression (2) (see FIG. 12A) is greater in force which acts in a direction orthogonal to the axial line CO of the spark plug 1100 and presses the metallic shell 1050 and the packing 1008 against each other. Force with which the metallic shell 1050 presses the packing 1008 is transmitted to the ceramic insulator 1010 through the packing 1008. Thus, the spark plug 1100 which satisfies the above relational expression (2) (see FIG. 12A) is greater in force which acts in a direction orthogonal to the axial line CO of the spark plug 1100 and presses the metallic shell 1050 and the ceramic insulator 1010 against each other. As a result, in the spark plug which satisfies the above relational expression (2), the metallic shell 1050 and the ceramic insulator 1010 are strongly pressed against each other in a direction orthogonal to the axial line of the spark plug; accordingly, although the spark plug 1100 receives vibration in a direction orthogonal to the axial direction, the ceramic insulator 1010 is unlikely to loosen, so that seal performance improves.

Also, according to the spark plug 1100, through satisfaction of the relational expression (3) mentioned above, load applied in a biased manner to the diameter reducing portion 1062 at the outer circumference side can be set to an appropriate range. Therefore, the following problem can be restrained: the biased load becomes excessively large such that the diameter reducing portion 1062 is greatly dented axially forward, resulting in a change of the insulator protruding dimension; as a result, variation in thermal characteristic (thermal value) among the spark plugs 1100 can be restrained.

TABLE 4

| θ21-θ22 (°) | −3 | −1 | 0 | 1 | 3 |
|---|---|---|---|---|---|
| Airtightness test | Good | Good | Fair | Good | Good |
| Deformation test | Fair | Fair | Good | Good | Good |

Table 4 shows the results of a first airtightness test and a deformation test conducted on the spark plugs 1100. These tests are related to the relational expression (1) mentioned above. In a first airtightness test, seal performance between the ceramic insulator 1010 and the metallic shell 1050 was examined at different values of "θ21−θ22." The employed samples of the spark plug 1100 satisfied the above relational expression (3) and did not satisfy the above relational expression (2). 10 samples were prepared for each of the values of "θ21−θ22." The first airtightness test was conducted according to the airtightness test specified in JIS B 8031. Specifically, after the samples of the spark plug 1100 were mounted to a test bed which simulated an internal combustion engine, and were held at 150° C. for 30 minutes, an air pressure of 1.5 MPa was applied to the interior of the test bed (to forward end portions of the samples), and the samples of the spark plug 1100 were checked for outward leakage of air from the crimped portions 1053 thereof. In the case where all of the samples in the same group were free of air leakage, the group was evaluated as "Good." In the case where at least a single sample in the same group suffered air leakage, the group was evaluated as "Fair." The present embodiment is set severer in evaluation criterion than JIS B 8031. Specifically, JIS B 8031 employs an air leakage rate of 1.0 ml/min or less as evaluation criterion, whereas the present embodiment employs whether or not air leakage exists, as an evaluation criterion.

As shown in Table 4, in the first airtightness test, only the samples having a value of "θ21−θ22" of 0° were evaluated as "Fair." The samples having a condition of θ21>θ22 or θ21<θ22 were evaluated as "Good."

In the deformation test, the samples of the spark plug 1100 which had undergone the first airtightness test were checked for deformation of the protrusion 1060. In the deformation test, the samples of the spark plug 1100 were disassembled; the metallic shells 1050 were cut; and the images of the resultant sections were captured. Next, on the basis of the images, whether or not the protrusions 1060 were deformed was judged. In the case where all of the samples in the same group were free of deformation of the protrusion 1060, the group was evaluated as "Good." In the case where at least a single sample in the same group suffered the deformation, the group was evaluated as "Fair."

Figure 13A:
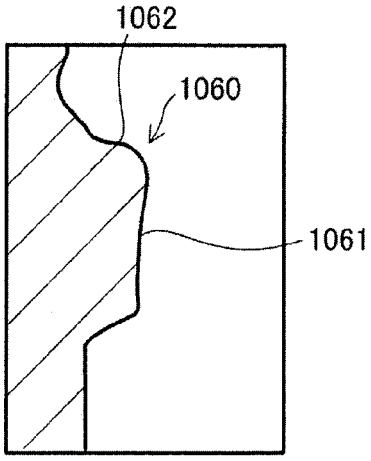
FIG. 13A is an explanatory view showing a method of judging, in a deformation test, whether or not a protrusion 1060 is deformed.
Figure 13B:
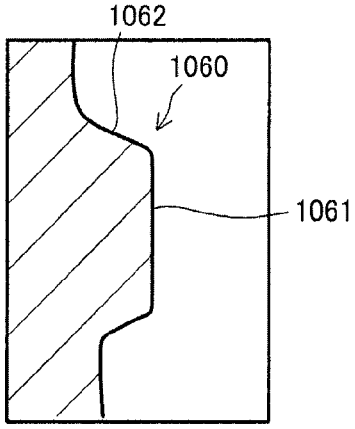
FIG. 13B is an explanatory view showing a method of judging, in the deformation test, whether or not the protrusion 1060 is deformed.
Figure 13C:
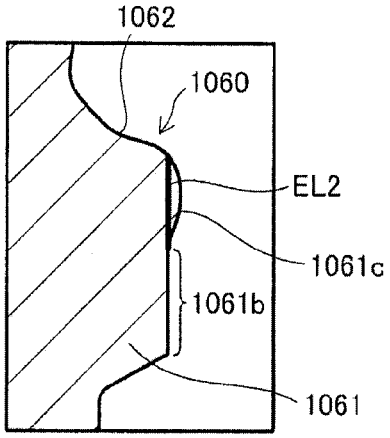
FIG. 13C is an explanatory view showing a method of judging, in the deformation test, whether or not the protrusion 1060 is deformed.

FIGS. 13A and 13B show a method of judging whether or not the protrusion 1060 is deformed. FIG. 13A shows a section of the deformed protrusion 1060. FIG. 13B shows a section of the protrusion 1060 free of deformation. FIG. 13C shows the method of judging whether or not deformation exists. As shown in FIG. 13C, according to this method, first, there is identified an undeformed segment; i.e., a straight segment (in FIG. 13C, an undeformed segment 1061*b*), of the outline of the top portion 1061 of the protrusion 1060. Next, the undeformed segment 1061*b* in the form of a straight line is imaginarily extended to form an extension line EL2, which is used as a reference line as follows: if a portion protruding radially inward beyond the extension line EL2 (in FIG. 13C, a deformed portion 1061*c*) exists, deformation is judged to be present.

As shown in Table 4, in the deformation test, the samples having a condition of θ21−θ22≤−1° were evaluated as "Fair." The samples having a condition of θ21−θ22≥0° were evaluated as "Good."

TABLE 5

| Mode | A | B | C |
|---|---|---|---|
| Presence of packing on imaginary line EL1 | Present | | Not present |
| Mode of contact between packing and metallic shell diameter-reducing-portion | Contact with entire metallic shell diameter-reducing portion | Contact with portion of metallic shell diameter-reducing portion | Contact with portion of metallic shell diameter-reducing portion |
| Airtightness test | Good | Good | Fair |

Table 5 shows the results of a second airtightness test conducted on the spark plugs 1100. The second airtightness test relates to the mode of the packing 1008; more specifically, a size and a position. In the second airtightness test, modes A to C were set for the packing 1008, and seal performance was evaluated for the individual modes by a method similar to that of the first airtightness test. The employed samples of the spark plug 1100 satisfied the above relational expression (1) and did not satisfy the above relational expressions (2) and (3).

Figure 14A:
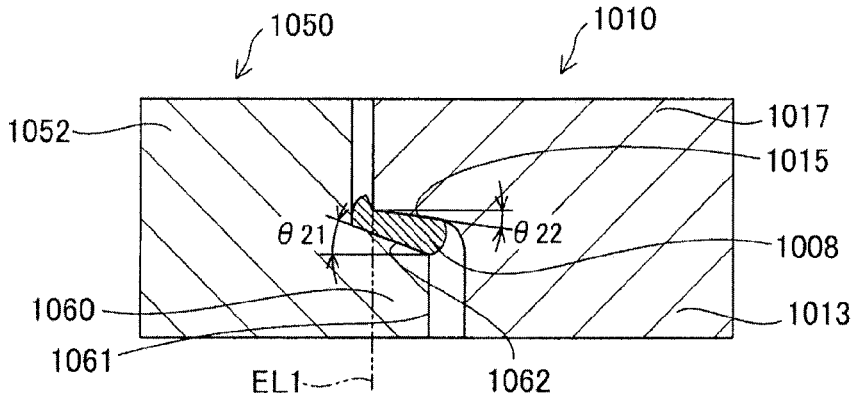
FIG. 14A is an explanatory view showing a mode of a packing 1008 in a second airtightness test.
Figure 14B:
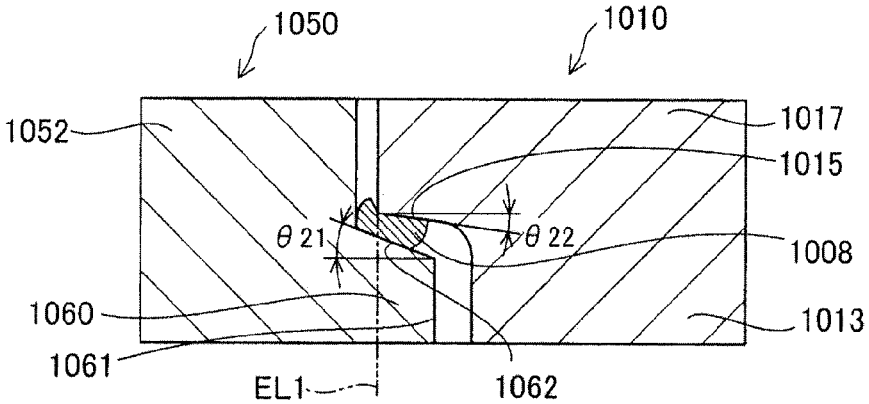
FIG. 14B is an explanatory view showing another mode of the packing 1008 in the second airtightness test.
Figure 14C:
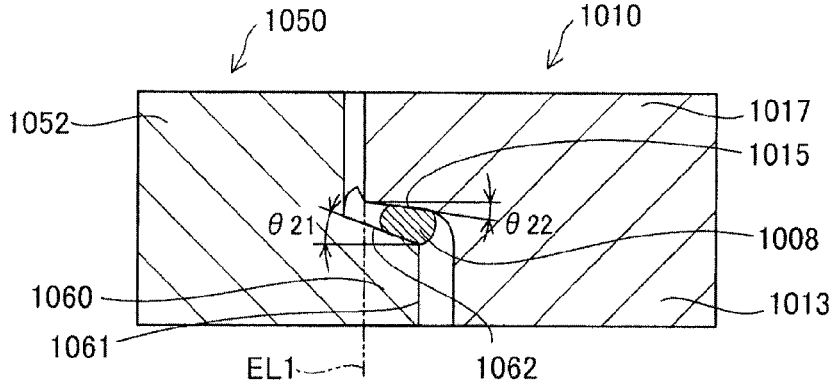
FIG. 14C is an explanatory view showing a further mode of the packing 1008 in the second airtightness test.

FIGS. 14A to 14C are explanatory views showing modes A to C of the packing 1008. The packing 1008 in mode A shown in FIG. 14A is disposed at such a position as to cross the above-mentioned extension line EL1. Also, the packing 1008 in mode A is disposed in such a manner as to come into contact with the entire surface of the diameter reducing portion 1062. That is, mode A is the mode of the packing 1008 in the present embodiment.

The packing 1008 in mode B shown in FIG. 14B is disposed, similar to mode A, at such a position as to cross the extension line EL1. The packing 1008 in mode B, unlike that in mode A, is disposed in such a manner as to come into contact with only a portion of the surface of the diameter reducing portion 1062.

The packing 1008 in mode C shown in FIG. 14C, unlike those in modes A and B, is disposed at such a position as to not cross the extension line EL1. Also, the packing 1008 in mode C, similar to that in mode B, is disposed in such a manner as to come into contact with only a portion of the surface of the diameter reducing portion 1062.

As shown in Table 5, in the second airtightness test conducted by use of the packings 1008 of modes A to C, the samples using the packings of modes A and B were evaluated as "Good." The samples using the packing of mode C were evaluated as "Fair." As is apparent from the above description, if the packing 1008 is disposed at such a position as to cross the extension line EL1, even though the packing 1008 is disposed in such a manner as to come into contact with only a portion of the surface of the diameter reducing portion 1062, predetermined seal performance is exhibited. Samples used in the first airtightness test and the deformation test mentioned above are of the spark plug 1100 which employs the packing of mode A.

TABLE 6

| θ21-θ22 (°) | | 6 | 7 | 8 | 9 | 10 |
|---|---|---|---|---|---|---|
| θ22 (°) | 26 | Fair | Fair | Fair | Fair | Fair |
| | 28 | Fair | Fair | Fair | Fair | Fair |
| | 30 | Good | Good | Good | Good | Good |
| | 32 | Good | Good | Good | Good | Good |

Airtightness Test

Table 6 shows the results of a third airtightness test conducted on the spark plugs 1100. The third airtightness test relates to the relational expressions (2) and (3) mentioned above. The third airtightness test examined seal performance between the ceramic insulator 1010 and the metallic shell 1050 at different values of "θ21−θ22" and the angle θ22. In the third airtightness test, first, impact was applied to the samples of the spark plug 1100 according to the impact test specified in JIS B 8031 7.4. Specifically, the spark plug 1100 is mounted to an iron jig with a predetermined fastening torque; then, impact with a stroke of 22 mm is applied at a rate of 400 times/min for 20 minutes. Impact was applied in a direction orthogonal to the center axis of the spark plug 1100 similarly to a direction in which the spark plug 1100 in use with an internal combustion engine receives vibration. The present embodiment employs severer impact conditions than those of JIS B 8031 7.4. Specifically, according to JIS B 8031 7.4, impact is applied for 10 minutes, whereas in the present embodiment, impact is applied for 20 minutes. After application of impact, the seal performance of the spark plug 1100 was evaluated by a method similar to that of the first airtightness test. Since impact is applied beforehand, the third airtightness test can be said to be severer in test conditions than the first airtightness test.

As shown in Table 6, in the third airtightness test, the samples having a condition of θ22≤28° were evaluated as "Fair." The samples having a condition of θ22≥30° were evaluated as "Good." The value of "θ21−θ22" had no effect on the result of evaluation.

TABLE 7

| θ21-θ22 (°) | | 6 | 7 | 8 | 9 | 10 |
|---|---|---|---|---|---|---|
| θ22 (°) | 26 | Good | Good | Fair | Fair | Fair |
| | 28 | Good | Good | Fair | Fair | Fair |
| | 30 | Good | Good | Fair | Fair | Fair |
| | 32 | Good | Good | Fair | Fair | Fair |

Heat Resistance Test

Table 7 shows the results of a first heat resistance test conducted on the spark plugs 1100. The first heat resistance test relates to the relational expressions (2) and (3) mentioned above. The first heat resistance test examined the heat resistance of the spark plug 1100 at different values of "θ21−θ22" and the angle θ22. The first heat resistance test used the spark plugs 1100 having heat value No. 7 as samples. Whether or not preignition occurred was examined at a CA (Crank Angle) which is −2° in relation to the lower limit of the advance angle of the spark plug having heat value No. 7 and mounted to a 1.6 L, L4 (straight 4-cylinder) engine. Since preignition occurs as a result of temperature increase at a forward end portion of the ceramic insulator 1010, nonoccurrence of preignition indicates that the spark plug 1100 has good heat transfer performance; i.e., heat resistance is high. The samples free of preignition were evaluated as "Good," and the samples which suffered preignition were evaluated as "Fair."

As shown in Table 7, in the first heat resistance test, the samples having a condition of θ21−δθ22≥8° were evaluated as "Fair." The samples having a condition of θ21−θ22≤7° were evaluated as "Good." The value of the angle θ22 had no effect on the result of evaluation.

C. Third Embodiment

Figure 15:
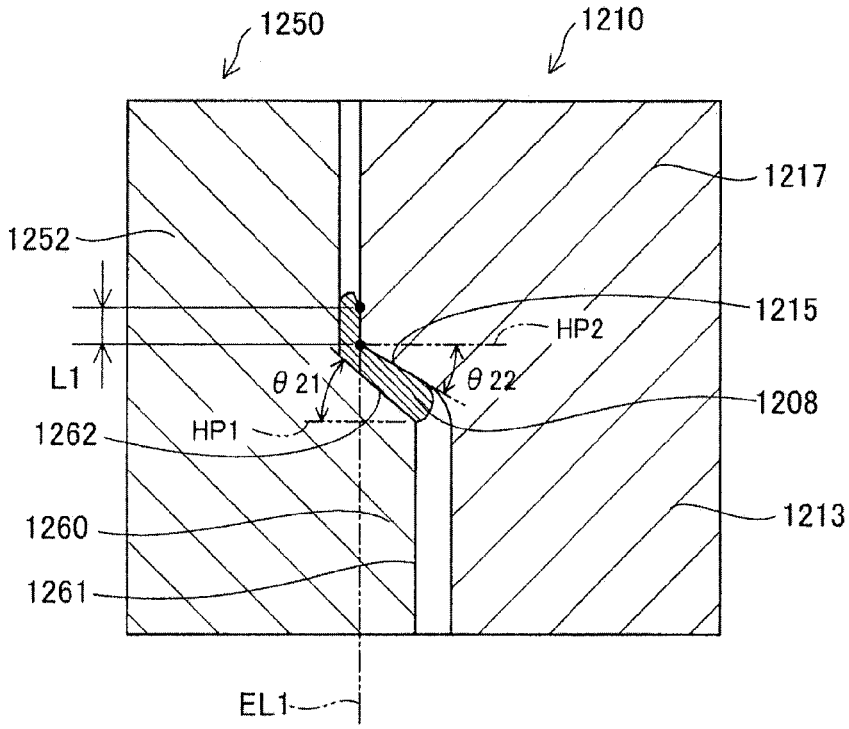
FIG. 15 is an enlarged sectional view showing a packing 1208 and its periphery of a spark plug 1200 according to a third embodiment of the present invention.

FIG. 15 is an enlarged sectional view showing a packing 1208 and its periphery of a spark plug 1200 according to a third embodiment of the present invention. In the following description, component members of the spark plug 1200 are denoted by reference numerals whose last two digits are identical with the last two digits of reference numerals assigned to corresponding component members of the spark plug 1100 (see FIGS. 9 and 10). The spark plug 1200 of the third embodiment differs from the spark plug of the second embodiment only in the mode of the packing 1208 and is identical to the spark plug of the second embodiment in other configurational features. The following description discusses only the difference from the second embodiment.

As shown in FIG. 15, the packing 1208 is disposed between a diameter reducing portion 1215 of a ceramic insulator 1210 and a diameter reducing portion 1262 of a metallic shell 1250 and between a forward trunk portion 1217 of the ceramic insulator 1210 and a portion of the metallic shell 1250 located rearward of the diameter reducing portion 1262. L1 is an axial length of that portion of the packing 1208 which is in contact with the forward trunk portion 1217 and with a portion of the metallic shell 1250 located rearward of the diameter reducing portion 1262. At this time, the spark plug 1200 satisfies the following relational expression (5).

$$L1 \geq 0.10\text{mm} \quad (5)$$

The spark plug 1200 having such a mode of the packing 1208 can be manufactured by various methods. For example, the following method of manufacturing the spark plug 1200 may be employed: the hardness of the packing 1208 is adjusted, and a crimped portion 1253 is formed through crimping such that a portion of the packing 1208 extends into a space between the forward trunk portion 1217 and a portion of the metallic shell 1250 located rearward of the diameter reducing portion 1262. Alternatively, the following method of manufacturing the spark plug 1200 may be employed: lubricating oil is applied to a space between the forward trunk portion 1217 and a portion of the metallic shell 1250 located rearward of the diameter reducing portion 1262 for allowing the packing 1208 to easily extend rearward; in this condition, the crimped portion 1253 is formed through crimping.

According to the thus-configured spark plug 1200, even when a clearance is formed between the diameter reducing portion 1262 and the packing 1208 due to screw elongation, with a resultant deterioration in seal performance, seal performance can be favorably ensured between the forward trunk portion 1217 and a portion of the metallic shell 1250 located rearward of the diameter reducing portion 1262. "Screw elongation" means elongation along the axial line CO of a mounting threaded portion 1252 resulting from the spark plug 1200 being fastened to the engine head 1150 with excessive torque, with a resultant axially forward elongation of a protrusion 1260. Generally, the amount of deformation caused by screw elongation is less than 0.10 mm. Thus, even in the event of screw elongation, since the spark plug 1200 of the present embodiment employs a length L1 of 0.10 mm or more, seal performance can be reliably ensured.

TABLE 8

| L1 (mm) | 0.08 | 0.09 | 0.10 | 0.11 |
|---|---|---|---|---|
| Airtightness test | Fair | Fair | Good | Good |

Table 8 shows the results of a fourth airtightness test conducted on the spark plug 1200. The fourth airtightness test examined seal performance between the ceramic insulator 1210 and the metallic shell 1250 at different values of the length L1 by a method substantially similar to that of the third airtightness test described above. The employed samples of the spark plug 1200 satisfied the above relational expression (1) and did not satisfy the above relational expressions (2) and (3). The fourth airtightness test differs from the third airtightness test only in a temperature condition and is similar in other conditions to the third airtightness test. Specifically, the third airtightness test employed a temperature condition of 150° C., whereas the fourth airtightness test employed a severer temperature condition of 200° C.

As shown in Table 8, in the fourth airtightness test, the samples having a condition of L1≤0.09 mm were evaluated as "Fair." The samples having a condition of L1≥0.10 mm were evaluated as "Good."

D. Fourth Embodiment

Figure 16:
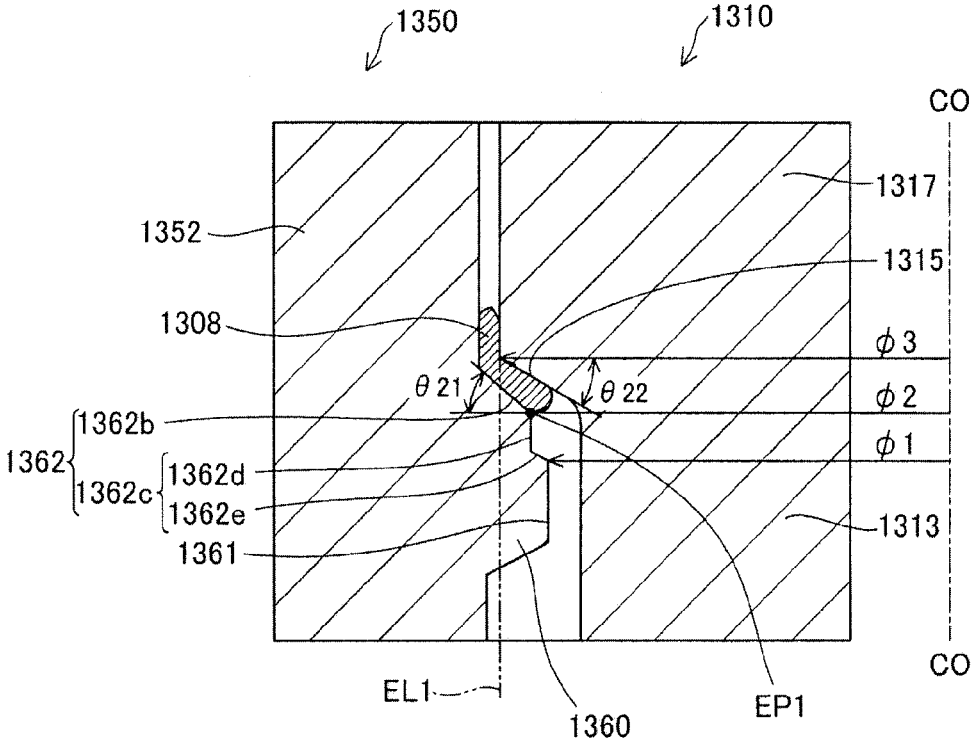
FIG. 16 is an enlarged sectional view showing a packing 1308 and its periphery of a spark plug 1300 according to a fourth embodiment of the present invention.

FIG. 16 is an enlarged sectional view showing a packing 1308 and its periphery of a spark plug 1300 according to a fourth embodiment of the present invention. In the following description, component members of the spark plug 1300 are denoted by reference numerals whose last two digits are identical with the last two digits of reference numerals assigned to corresponding component members of the spark plug 1100 (see FIGS. 9 and 10). The spark plug 1300 of the fourth embodiment differs from the spark plug of the second embodiment in the shape of a protrusion 1360. The mode of the packing 1308 is that shown in the third embodiment, but may be that shown in the second embodiment. Other configurational features of the spark plug 1300 are similar to those of the spark plug 1100. The following description discusses only the shape of the protrusion 1360.

The protrusion 1360 includes a top portion 1361 and a diameter reducing portion 1362. The diameter reducing portion 1362 includes a rear diameter reducing portion 1362*b* and an intermediate portion 1362*c*. The rear diameter reducing portion 1362*b* is a portion of the diameter reducing portion 1362 located most rearward and corresponding to the diameter reducing portion 1062 of the second embodiment. The intermediate portion 1362*c* is connected to the top portion 1361. The intermediate portion 1362*c* is located between the rear diameter reducing portion 1362*b* and the top portion 1361. The intermediate portion 1362*c* includes a first intermediate portion 1362*d* and a second intermediate portion 1362*e*. The first intermediate portion 1362*d* is connected to the rear diameter reducing portion 1362*b* and has a fixed inside diameter. The second intermediate portion 1362*e* is connected to the first intermediate portion 1362*d* and to the top portion 1361, and its inside diameter reduces forward. In the present embodiment, the inside diameter of the first intermediate portion 1362*d* is greater than an inside diameter measured at any position of the second intermediate portion 1362*e*.

In the thus-shaped protrusion 1360, the angle θ21 is an acute angle between a straight line orthogonal to the axial line CO and the outline of a most rearward portion of the diameter reducing portion 1362 of the metallic shell 1350. "A most rearward portion of the diameter reducing portion 1362 of the metallic shell 1350" is a portion (rear diameter reducing portion 1362*b*) of the diameter reducing portion 1362 connected to the rear end of the first intermediate portion 1362*d*.

ϕ1 is the inside diameter of the top portion 1361. ϕ2 is the inside diameter of the intermediate portion 1362*c* measured at its axially rear end point EP1 (in FIG. 16, the inside diameter of the first intermediate portion 1362*d*). ϕ3 is the outside diameter of a forward trunk portion 1317. The diameters ϕ1 to ϕ3 have the relation ϕ1<ϕ2<ϕ3. At this time, the spark plug 1300 satisfies the following relational expressions (6) and (7). The relational expressions (6) and (7) represent selective conditions.

$$\phi 2/\phi 1 \geq 1.01 \quad (6)$$

$$\phi 2/\phi 3 \leq 0.95 \quad (7)$$

According to the thus-configured spark plug 1300, since the intermediate portion 1362*c* is formed in such a manner as to cut off a portion of the top portion 1361, at the position of the intermediate portion 1362*c*, the distance along the orthogonal direction between the protrusion 1360 and the ceramic insulator 1310 increases. Therefore, a space is ensured for a radially inward deformation of the protrusion 1360. That is, even though the protrusion 1360 is deformed in such a manner as to protrude toward the ceramic insulator 1310, there can be restrained press of an inner circumferential portion of the packing 1308 against the ceramic insulator 1310. As a result, there can be restrained damage to the ceramic insulator 1310 caused by deformation of the protrusion 1360.

Also, according to the spark plug 1300, through satisfaction of the above relational expression (6), the contact area between the metallic shell 1350 and the packing 1308 is usefully reduced. As a result, surface pressure applied to the rear diameter reducing portion 1362*b* increases, whereby seal performance between the ceramic insulator 1310 and the metallic shell 1350 can be improved. This effect is yielded for the above-mentioned reason and can be yielded even though the above relational expression (7) is not satisfied.

Also, according to the spark plug 1300, through satisfaction of the above relational expression (7), there can be avoided an excessive reduction in the contact area between the rear diameter reducing portion 1362*b* and the packing 1308. As a result, the following problem can be restrained: surface pressure applied to the rear diameter reducing portion 1362*b* increases excessively such that the rear diameter reducing portion 1362*b* is greatly dented forward, resulting in a change of the insulator protruding dimension. That is, variation in the insulator protruding dimension is restrained; as a result, variation in thermal characteristic among the spark plugs 1300 can be restrained. This effect is yielded for the above-mentioned reason and can be yielded even though the above relational expression (6) is not satisfied.

Figure 17:
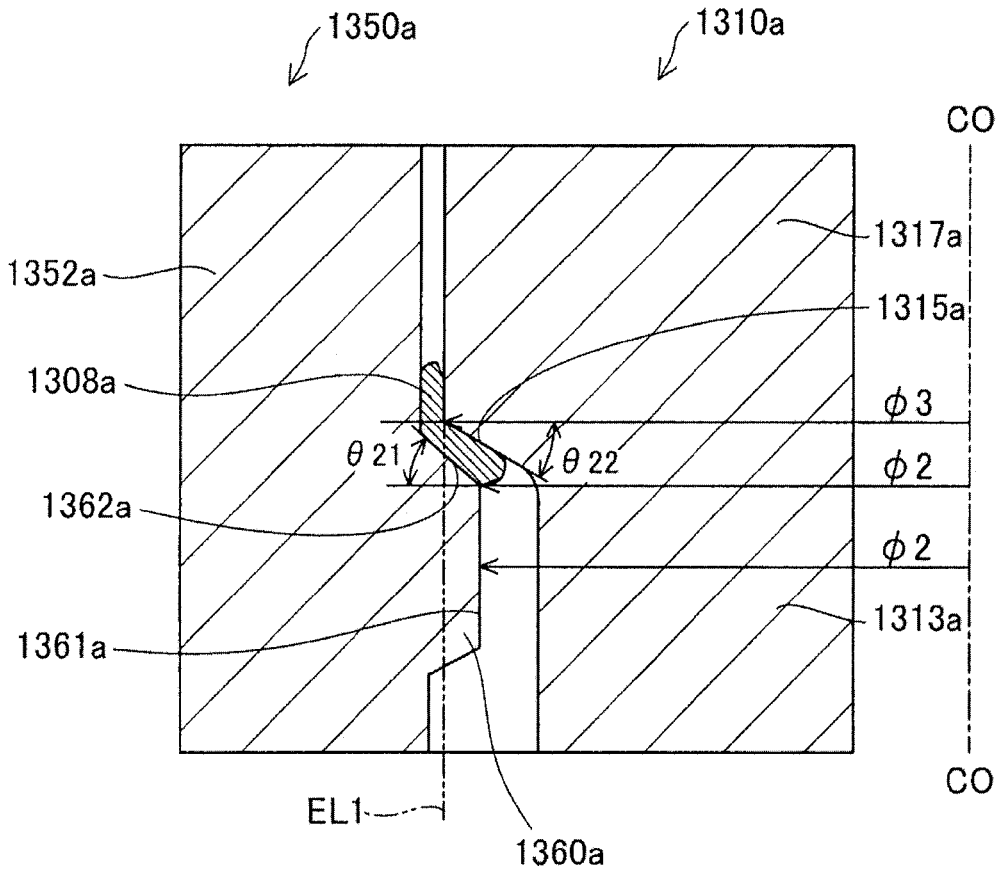
FIG. 17 is an enlarged sectional view showing a packing 1308*a* and its periphery of a spark plug 1300*a* according to Comparative Example.

FIG. 17 is an enlarged sectional view showing a packing 1308*a* and its periphery of a spark plug 1300*a* according to Comparative Example. In FIG. 17, component members of the spark plug 1300*a* are denoted by reference numerals assigned to corresponding component members of the spark plug 1300 (see FIG. 16) with suffix "a." The spark plug 1300*a* differs from the spark plug 1300 only in the shape of a protrusion 1360*a* and is identical to the spark plug 1300 in other features.

The protrusion 1360*a* of the spark plug 1300*a* does not have a portion corresponding to the intermediate portion 1362*c* of the spark plug 1300. That is, the protrusion 1360*a* of the spark plug 1300*a* has the same shape as that of the protrusion 1060 in the second embodiment. The inside diameter of a top portion 1361*a* is identical with the inside diameter ϕ2 of the first intermediate portion 1362*d* of the spark plug 1300. That is, the distance along the orthogonal direction between a top portion 1361*a* and a leg portion 1313*a* is greater than that between the top portion 1361 and the leg portion 1313 of the spark plug 1300. In the spark plug 1300*a*, similar to the spark plug 1300, there can be restrained damage to a ceramic insulator 1310*a* caused by deformation of the protrusion 1360*a*.

According to the spark plug 1300 of the above embodiment, as compared with the spark plug 1300*a* of Comparative Example, the distance along the orthogonal direction to the axial line CO between the top portion 1361 and the leg portion 1313 is smaller; therefore, in use of the spark plug 1300, rearward penetration of combustion gas can be restrained. As a result, heat resistance can be favorably ensured. That is, the spark plug 1300 can attain compatibility between ensuring of heat resistance and restraint of damage to the ceramic insulator 1310 caused by deformation of the protrusion 1360, which are in trade-off relation with each other.

TABLE 9

| ϕ2/ϕ1 | | 1.00 | 1.01 | 1.02 | 1.03 |
|---|---|---|---|---|---|
| ϕ2/ϕ3 | 0.94 | Fair | Good | Good | Good |
| | 0.95 | Fair | Good | Good | Good |
| | 0.96 | Fair | Good | Good | Good |
| | 0.97 | Fair | Good | Good | Good |

Airtightness Test

Table 9 shows the results of a fifth airtightness test conducted on the spark plug 1300. The fifth airtightness test examined seal performance between the ceramic insulator 1310 and the metallic shell 1350 at different combinations of values of "ϕ2/ϕ1" and values of "ϕ2/ϕ3" by a method substantially similar to that of the above-mentioned fourth airtightness test. The employed samples of the spark plug 1300 satisfied the above relational expression (1) and did not satisfy the relational expressions (2), (3), and (5). The fifth airtightness test differed from the fourth airtightness test in a temperature condition and a fastening condition and is identical to the fourth airtightness test in other conditions. Specifically, the fourth airtightness test employed a temperature condition of 200° C., whereas the fifth airtightness test employed a severer temperature condition of 250° C. Also, the spark plug 1300 was fastened with a higher torque than in the fourth airtightness test.

As shown in Table 9, in the fifth airtightness test, the samples having a value of ϕ2/ϕ1 of 1.00 were evaluated as "Fair." The samples having a condition of ϕ2/ϕ1≥1.01 were evaluated as "Good." The value of "ϕ2/ϕ3" had no effect on the result of evaluation.

TABLE 10

| ϕ2/ϕ1 | | 1.00 | 1.01 | 1.02 | 1.03 |
|---|---|---|---|---|---|
| ϕ2/ϕ3 | 0.94 | Good | Good | Good | Good |
| | 0.95 | Good | Good | Good | Good |
| | 0.96 | Fair | Fair | Fair | Fair |
| | 0.97 | Fair | Fair | Fair | Fair |

Heat Resistance Test

Table 10 shows the results of a second heat resistance test conducted on the spark plug 1300. The second heat resistance test examined heat resistance of the spark plug 1300 at different combinations of values of "ϕ2/ϕ1" and values of "ϕ2/ϕ3." The employed samples of the spark plug 1300 satisfied the above relational expression (1) and did not satisfy the relational expressions (2), (3), and (5). The second heat resistance test is similar in method to the first heat resistance test mentioned above.

As shown in Table 10, in the second heat resistance test, the samples having a condition of ϕ2/ϕ3≥0.96 were evaluated as "Fair." The samples having a condition of ϕ2/ϕ3≤0.95 were evaluated as "Good." The value of "ϕ2/ϕ1" had no effect on the result of evaluation.

D. Modified Embodiment

The shape of the intermediate portion 1362*c* is not limited to the one mentioned above, but can be modified variously. The shape of the intermediate portion 1362*c* may be such that, in contrast to a configuration having no intermediate portion 1362*c*, the inside diameter of the rear diameter reducing portion 1362*b* measured at its forward end point; in other words, the inside diameter of the intermediate portion 1362*c* measured at its rear end point EP1, is greater than the inside diameter of the top portion 1361. The intermediate portion 1362*c* may have any shape, for example, such that the inside diameter of the intermediate portion 1362*c* is smaller than the inside diameter of the rear diameter reducing portion 1362*b* measured at its forward end point and is greater than the inside diameter of the top portion 1361.

Figure 18:
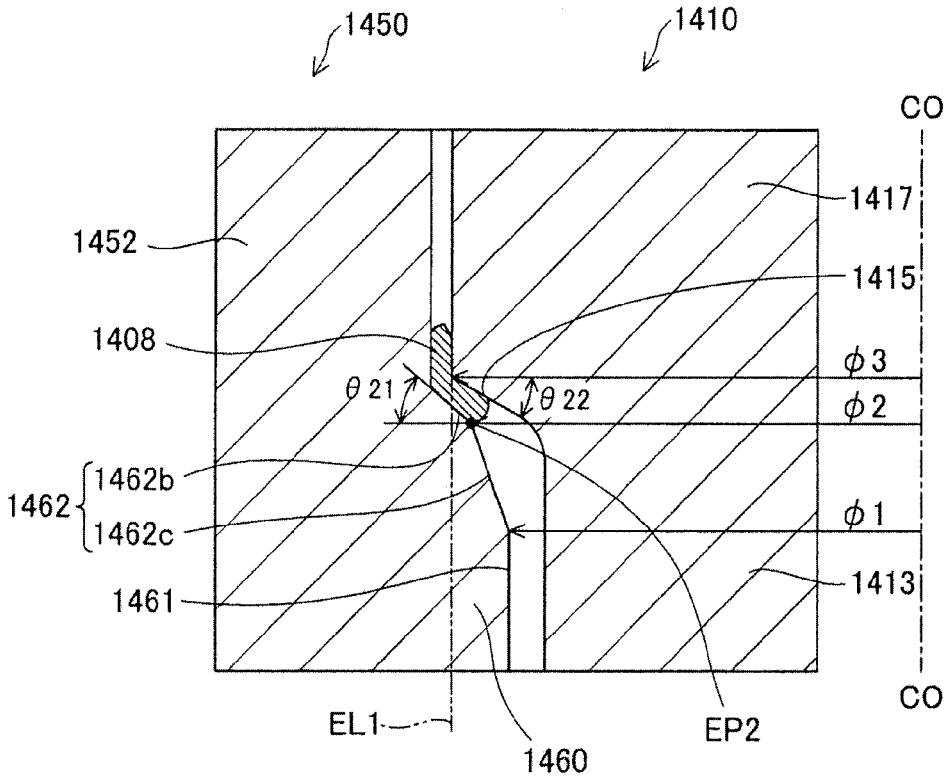
FIG. 18 is an enlarged sectional view showing a packing 1408 and its periphery of a spark plug 1400 according to a modified embodiment of the present invention.

FIG. 18 is an enlarged sectional view showing a packing 1408 and its periphery of a spark plug 1400 according to a modified embodiment of the present invention. In the following description, component members of the spark plug 1400 are denoted by reference numerals whose last two digits are identical with the last two digits of reference numerals assigned to corresponding component members of the spark plug 1300 (see FIG. 16). The spark plug 1400, which is the modified embodiment, differs from the spark plug of the fourth embodiment only in the shape of an intermediate portion 1462*c*. Other configurational features of the spark plug 1400 are similar to those of the spark plug 1300 of the fourth embodiment. The following description discusses only the shape of the intermediate portion 1462*c*.

The intermediate portion 1462*c* connects a rear diameter reducing portion 1462*b* and a top portion 1461. The intermediate portion 1462*c* is formed such that its inside diameter reduces forward. That is, the intermediate portion 1462*c* is configured to not have the first intermediate portion 1362*d* of the fourth embodiment. Even in such a configuration, as compared with a configuration in which the intermediate portion 1462*c* is not included, there increases the distance along the orthogonal direction between a protrusion 1460 and a leg portion 1413 as measured at a rear end point EP2 of the intermediate portion 1462*c*; therefore, damage to a ceramic insulator 1410 caused by deformation of the protrusion 1460 can be restrained to a certain extent.

Figure 19:
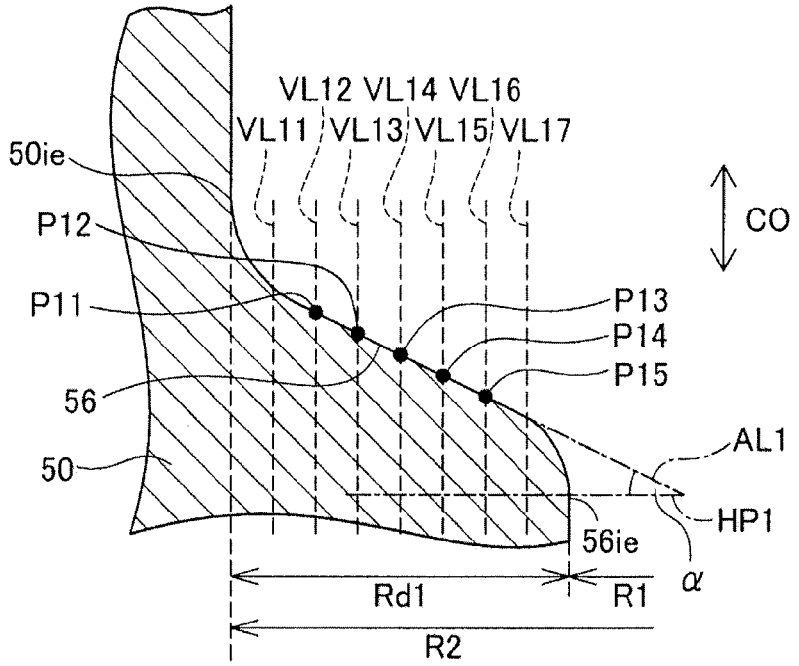
FIG. 19 is a view showing a method of determining a first angle θ1 between an inside diameter reducing portion 56 of a metallic shell 50 and an imaginary plane HP1 perpendicular to a center axis CO.

FIG. 19 is a view showing a method of determining the first angle θ1 (see FIG. 2) between the inside diameter reducing portion 56 of the metallic shell 50 and the imaginary plane HP1 perpendicular to the center axis CO. FIG. 19 does not show the center axis CO, but the bidirectional arrow indicates the direction of the center axis CO. In a plane which contains the center axis CO of the spark plug 100, the first angle θ1 between the inside diameter reducing portion 56 and the imaginary plane HP1 is determined as follows.

(a1) First, on one side with respect to the center axis CO (see FIG. 2), R1 represents the inside radius of a most radially inner portion 56*ie* of the inside diameter reducing portion 56, and R2 represents the inside radius of a portion 50*ie* of the metallic shell 50 extending axially rearward from the rear end of the inside diameter reducing portion 56. A radius difference Rd1 between the radius R1 and the radius R2 is obtained.

(a2) VL11 to VL17 represent seven imaginary straight lines which are in parallel with the axial line CO and which divide a span orthogonal to the axial line CO between the most radially inner portion 56*ie* (having the radius R1) of the inside diameter reducing portion 56 and the portion 50*ie* (having the radius R2) of the metallic shell 50 extending axially rearward from the rear end of the inside diameter reducing portion 56, into eight equal segments.

(a3) Of the imaginary straight lines VL11 to VL17, the outermost imaginary straight line VL11 and the innermost imaginary straight line VL17 are eliminated, and P11 to P15 represent intersections between the remaining five imaginary straight lines VL12 to VL16 and the outline of the inside diameter reducing portion 56.

(a4) An acute angle between an approximate straight line AL1 approximating the points P11 to P15 and the straight line HP1 indicative of the imaginary plane HP1 perpendicular to the center axis CO is obtained as an angle α.

(a5) On the other side with respect to the center axis CO (see FIG. 2), the angle α is obtained by a method similar to that described above in (a1) to (a4). For the purpose of distinction, in a plane which contains the center axis CO of the spark plug 100, α1 represents the angle α on one side with respect to the center axis CO, and α2 represents the angle α on the other side.

(a6) The average of the angle α1 and the angle α2 is the first angle θ1.

The method of determining the angle of the outline of the metallic shell diameter-reducing-portion has been described while mentioning the first angle θ1 (see FIG. 2) of the spark plug 100 of the first embodiment. However, in the spark plug 1100 of the second embodiment, an acute angle θ21 (see FIG. 10) between the plane HP1 orthogonal to the axial line CO and the outline of the diameter reducing portion 1062 of the metallic shell 1050 can also be determined similarly. That is, "the first angle (an acute angle between a straight line orthogonal to the axial line and an outline of the metallic shell diameter-reducing-portion)" appearing in the present specification is determined by the procedure mentioned above in (a1) to (a6).

Figure 20:
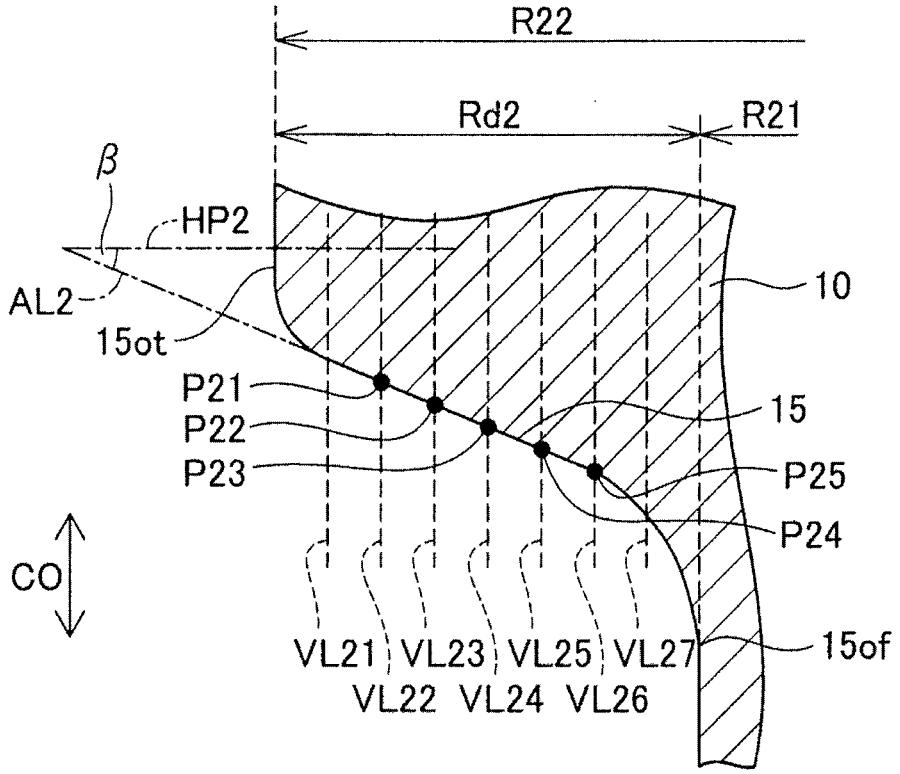
FIG. 20 is a view showing a method of determining a second angle θ2 between an insulator first-diameter-reducing-portion 15 of a ceramic insulator 10 and an imaginary plane HP2 perpendicular to the center axis CO.

FIG. 20 is a view showing a method of determining the second angle θ2 (see FIG. 2) between the insulator first-diameter-reducing-portion 15 of the ceramic insulator 10 and the imaginary plane HP2 perpendicular to the center axis CO. FIG. 20 does not show the center axis CO, but the bidirectional arrow indicates the direction of the center axis CO. In a plane which contains the center axis CO of the spark plug 100, the second angle θ2 between the insulator first-diameter-reducing-portion 15 and the imaginary plane HP2 is determined as follows.

(b1) First, on one side with respect to the center axis CO (see FIG. 2), R22 represents the outside radius of a rear end portion 15*ot* of the insulator first-diameter-reducing portion 15, and R21 represents the outside radius of a forward end portion 15*of* of the insulator first-diameter-reducing-portion 15. A radius difference Rd2 between the radius R21 and the radius R22 is obtained.

(b2) VL21 to VL27 represent seven imaginary straight lines which are in parallel with the axial line CO and which divide a span orthogonal to the axial line CO between the rear end portion 15*ot* (having the radius R22) of the insulator first-diameter-reducing-portion 15 and the forward end portion 15*of* (having the radius R21) of the insulator first-diameter-reducing-portion 15, into eight equal segments.

(b3) Of the imaginary straight lines VL21 to VL27, the outermost imaginary straight line VL21 and the innermost imaginary straight line VL27 are eliminated, and P21 to P25 represent intersections between the remaining five imaginary straight lines VL22 to VL26 and the outline of the insulator first-diameter-reducing-portion 15.

(b4) An acute angle between an approximate straight line AL2 approximating the points P21 to P25 and the straight line HP2 indicative of the imaginary plane HP2 perpendicular to the center axis CO is obtained as an angle β.

(b5) On the other side with respect to the center axis CO (see FIG. 2), the angle β is obtained by a method similar to that described above in (b1) to (b4). For the purpose of distinction, in a plane which contains the center axis CO of the spark plug 100, β1 represents the angle β on one side with respect to the center axis CO, and β2 represents the angle β on the other side.

(b6) The average of the angle β1 and the angle β2 is the second angle θ2.

The method of determining the angle of the outline of the diameter reducing portion of the insulator has been described while mentioning the second angle θ2 (see FIG. 2) of the spark plug 100 of the first embodiment. However, in the spark plug 1100 of the second embodiment, an acute angle θ22 (see FIG. 10) between the plane HP2 orthogonal to the axial line CO and the outline of the diameter reducing portion 1015 of the ceramic insulator 1010 can also be determined similarly. That is, "the second angle (an acute angle between a straight line orthogonal to the axial line and an outline of the insulator first-diameter-reducing portion)" appearing in the present specification is determined by the procedure mentioned above in (b1) to (b6).

Embodiments of the present invention have been described above. However, the present invention is not limited to the embodiments and may be embodied in various other forms without departing from the spirit of the invention. For example, in a mode which can solve, at least partially, the problem mentioned in the present application, or a mode which can yield, at least partially, the effects mentioned above, the constituent elements of the above-mentioned embodiments and the elements in the above embodiments may be combined, omitted, or changed to generic concepts as appropriate. For example, there can be employed a mode which satisfies part or all of the conditions of the first embodiment while satisfying one or more of the relational expressions (1) to (7) of the second to fourth embodiments.

DESCRIPTION OF REFERENCE NUMERALS

5: gasket
6: first rear packing
6*f*: forward end of the first rear packing 6
7: second rear packing
7*b*: rear end of the second rear packing 7
8: forward packing
9: talc
10: ceramic insulator
10*o*: outer circumferential surface
11: insulator second-diameter-reducing-portion
11*f*: forward end of the insulator second-diameter-reducing-portion 11
12: through hole
13: leg portion
15: insulator first-diameter-reducing-portion

15*b*: rear end of the insulator first-diameter-reducing-portion 15
15*o*: outer circumferential surface
16: inside diameter reducing portion
17: forward trunk portion
18: rear trunk portion
19: collar portion
20: center electrode
21: electrode base metal
22: core
24: collar portion
28: electrode tip
30: ground electrode
31: distal end portion
32: electrode base metal
38: electrode tip
40: metal terminal member
41: cap attachment portion
42: collar portion
43: leg portion
50: metallic shell
50*i*: inner circumferential surface
51: tool engagement portion
52: threaded portion
53: crimped portion
54: seal portion
54*a*: forward end surface of seal portion 54
55: trunk portion
56: inside diameter reducing portion
56*b*: rear end of the inside diameter reducing portion 56
56*f*: forward end of the inside diameter reducing portion 56
56*i*: inner circumferential surface of the inside diameter reducing portion 56
56*s*: step
56*x*: inside diameter reducing portion
56*xb*: rear end of the inside diameter reducing portion 56*x*
56*xi*: inner circumferential surface of the inside diameter reducing portion 56*x*
58: deformed portion
58*c*: groove
58*cb*: rear end of the groove 58*c*
59: through hole
60: electrically conductive seal
70: resistor
80: electrically conductive seal
100: spark plug
100*x*: spark plug
1003: ceramic resistor
1004: seal body
1005: gasket
1008, 1008*a*, 1208, 1308, 1308*a*, 1408: packing
1010, 1010*a*, 1210, 1310, 1310*a*, 1410: ceramic insulator
1012: axial hole
1013, 1013*a*, 1213, 1313, 1313*a*, 1413: leg portion
1015, 1015*a*, 1215, 1315, 1315*a*, 1415: diameter reducing portion
1017, 1017*a*, 1217, 1317, 1317*a*, 1417: forward trunk portion
1018: rear trunk portion
1019: center trunk portion
1020: center electrode
1021: electrode base metal
1025: core
1030: ground electrode
1040: terminal electrode
1050, 1050*a*, 1250, 1350: metallic shell
1051: tool engagement portion
1052, 1052*a*, 1252, 1352, 1352*a*, 1452: mounting threaded portion
1053, 1253: crimped portion
1054: seal portion
1057: forward end surface
1060, 1060*a*, 1260, 1360, 1360*a*, 1460: protrusion
1061, 1061*a*, 1261, 1361, 1361*a*, 1461: top portion
1061*b*: undeformed segment
1061*c*: deformed portion
1062, 1062*a*, 1262, 1362, 1362*a*: diameter reducing portion
1100, 1100*a*, 1200, 1300, 1300*a*, 1400: spark plug
1150: engine head
1151: mounting threaded portion
1362*b*, 1462*b*: rear diameter reducing portion
1362*c*, 1462*c*: intermediate portion
1362*d*: first intermediate portion
1362*e*: second intermediate portion
A1: first distance
A2: second distance
AL1: approximation straight line
C: parameter
CA: contact region
CAi: inner region of the contact region CA
CAo: outer region of the contact region CA
CO: center axis (axial line)
COx: center axis
CP: intersection point
D1: first diameter
D2: second diameter
Dr1: first direction
Dr2: second direction
EL1, EL2: extension line
EP1, EP2: end point
F1: first force applied in first direction Dr1 from crimped portion 53 to first rear packing 6
F2*a*: force applied in first direction Dr1 to ceramic insulator 10
F2*b*: force applied in first direction Dr1 to ceramic insulator 10
H1: length (first length, parameter) in parallel with the axial line of the filler space filled with cushioning material
H2: length (second length) in parallel with the axial line between the rear end of the filler space and the projection position of the rear end of the insulator first-diameter-reducing-portion of the ceramic insulator, the projection position being obtained by projecting the rear end of the insulator first-diameter-reducing-portion on the inner circumferential surface of the inside diameter reducing portion of the metallic shell in parallel with the axial line HP1: imaginary plane perpendicular to center axis CO
HP2: imaginary plane perpendicular to center axis CO
L: line corresponding to the contact region CA in the section of the spark plug 100
LP: first portion whose inside diameter changes linearly with the axial position
Lx: line corresponding to the contact region between the inside diameter reducing portion 56*x* and the forward packing 8
Nng: leakage vibration count
PF1: first enlarged fragmentary view
PF2: second enlarged fragmentary view
PP: projection position of the rear end 15*b* (position from which the outside diameter begins to reduce) of the insulator first-diameter-reducing-portion 15 of the ceramic insulator 10, the projection position being obtained by projecting the rear end 15*b* on the inner circumferential surface 56*i* of the inside diameter reducing portion 56 of the metallic shell 50 in parallel with the center axis CO Pi: inner partial pressure Po: outer partial pressure R1: first radius R2: second radius RP: second portion S: area of contact region CA (contact area, parameter)

SG: spark gap

SP: annular space between the inner circumferential surface of a portion of the metallic shell 50 ranging from the tool engagement portion 51 to the crimped portion 53 and the outer circumferential surface of portion of the ceramic insulator 10 ranging from the insulator second diameter reducing portion 11 to the intermediate portion of the rear trunk portion 18

SPF: filler space filled with talc

Spi: fragmentary area corresponding to the segment

St: target area of the contact region CA

T: temperature of the seat surface of the test bed at a flow rate of 10 $cm^3$/min or more of air leaking at the forward packing 8 (leak temperature)

T2: temperature of the seat surface of the test bed at a flow rate of 5 $cm^3$/min or more of leaking air (leak temperature)

V: volume of the space having the first length H1 and the width C

Vt: target value of the volume V (target volume)

θ1: acute angle between the inside diameter reducing portion 56 (inner circumferential surface 56*i*) of the metallic shell 50 and the imaginary plane HP1 perpendicular to the center axis CO (first angle, parameter)

θ2: acute angle between the insulator first-diameter-reducing-portion 15 (outer circumferential surface 15*o*) of the ceramic insulator 10 and the imaginary plane HP2 perpendicular to the center axis CO (second angle)

θ21: acute angle between the plane HP1 (straight line on sectional view) orthogonal to the axial line CO and the outline of the diameter reducing portion 1062 of the metallic shell 1050

θ22: acute angle between the plane HP2 (straight line on sectional view) orthogonal to the axial line CO and the outline of the diameter reducing portion 1015 of the ceramic insulator 1010

The invention claimed is:

1. A spark plug comprising:

a center electrode extending along an axial line;

an insulator having an axial hole extending along the axial line and holding the center electrode in the axial hole in such a manner that the center electrode protrudes axially forward from the axial hole;

a metallic shell holding the insulator in such a manner as to circumferentially surround a portion of the insulator; and an annular seal member that seals a gap between the insulator and the metallic shell, wherein the insulator includes a first portion, a second portion located axially forward of the first portion and being smaller in outside diameter than the first portion, and an insulator first-diameter-reducing-portion whose outside diameter reduces axially forward and which connects the first portion and the second portion, the metallic shell includes a protrusion protruding radially inward, said protrusion having a metallic shell diameter-reducing-portion whose inside diameter reduces axially forward, the seal member is disposed between the insulator first-diameter-reducing-portion and the metallic shell diameter-reducing-portion at such a position as to cross an extension line formed by imaginarily extending an outer surface of the first portion in an axially forward direction, a first angle θ21 and a second angle θ22 satisfy a relational expression θ21>θ22, where, on a section which contains the axial line, the first angle θ21 is an acute angle between a straight line orthogonal to the axial line and an outline of the metallic shell diameter-reducing-portion, and the second angle θ22 is an acute angle between a straight line orthogonal to the axial line and an outline of the insulator first-diameter-reducing-portion, and the first angle θ21 and the second angle θ22 satisfy a relational expression θ21−θ22≤7°.

2. The spark plug according to claim 1, wherein the second angle θ22 satisfies a relational expression θ22≥30°.

3. The spark plug according to claim 2, wherein the first angle θ21 and the second angle θ22 satisfy a relational expression θ21−θ22≤7°.

4. The spark plug according to claim 2, wherein the seal member is disposed in such a manner as to extend from at least a portion of a space between the insulator first-diameter-reducing-portion and the metallic shell diameter-reducing-portion into a space between the first portion and a portion of the metallic shell located axially rearward of the metallic shell diameter-reducing-portion, and a portion of the seal member in contact with the first portion and with the portion of the metallic shell has an axial length of 0.10 mm or more.

5. The spark plug according to claim 2, wherein the protrusion has a top portion having a fixed smallest inside diameter;

the metallic shell diameter-reducing-portion comprises an intermediate portion connected to the top portion; and an inside diameter ϕ1 of the top portion and an inside diameter ϕ2 of the intermediate portion measured at its rear end point satisfy a relational expression ϕ2/ϕ1≥1.01.

6. The spark plug according to claim 1, wherein the seal member is disposed in such a manner as to extend from at least a portion of a space between the insulator first-diameter-reducing-portion and the metallic shell diameter-reducing-portion into a space between the first portion and a portion of the metallic shell located axially rearward of the metallic shell diameter-reducing-portion, and a portion of the seal member in contact with the first portion and with the portion of the metallic shell has an axial length of 0.10 mm or more.

7. The spark plug according to claim 6, wherein the protrusion has a top portion having a fixed smallest inside diameter;

the metallic shell diameter-reducing-portion comprises an intermediate portion connected to the top portion; and an inside diameter ϕ1 of the top portion and an inside diameter ϕ2 of the intermediate portion measured at its rear end point satisfy a relational expression ϕ2/ϕ1≥1.01.

8. The spark plug according to claim 1, wherein the protrusion has a top portion having a fixed smallest inside diameter;

the metallic shell diameter-reducing-portion comprises an intermediate portion connected to the top portion; and an inside diameter $\phi 1$ of the top portion and an inside diameter $\phi 2$ of the intermediate portion measured at its rear end point satisfy a relational expression $\phi 2/\phi 1 \geq 1.01$.

9. The spark plug according to claim 8, wherein an outside diameter $\phi 3$ of the first portion satisfies a relational expression $\phi 2/\phi 3 \leq 0.95$.

10. The spark plug according to claim 9, wherein the intermediate portion comprises a first intermediate portion having a fixed inside diameter and a second intermediate portion which connects the first intermediate portion and the top portion.

11. The spark plug according to claim 8, wherein the intermediate portion comprises a first intermediate portion having a fixed inside diameter and a second intermediate portion which connects the first intermediate portion and the top portion.

12. The spark plug according to claim 1, wherein the metallic shell includes a threaded portion formed on its outer surface and having a nominal diameter of M10;

a contact region between the metallic shell diameter-reducing-portion and the seal member has an area of 12.3 $mm^2$ or less; and the first angle is 27 degrees to 50 degrees.

13. The spark plug according to claim 12, wherein the insulator includes an insulator second-diameter-reducing-portion which is located axially rearward of the insulator first-diameter-reducing-portion and whose outside diameter reduces axially rearward;

the metallic shell includes a crimped portion which forms a rear end thereof, is located axially rearward of the insulator second-diameter-reducing portion of the insulator, and is bent radially inward;

a filler space is located between the crimped portion and the insulator second-diameter-reducing-portion of the insulator and is surrounded by an inner circumferential surface of the metallic shell and an outer circumferential surface of the insulator, and is filled with a cushioning material;

the filler space has a volume of 119 $mm^3$ to 151 $mm^3$;

the filler space has an axial length of 3 mm or more; and the filler space has a radial width of 0.66 mm or more.

14. The spark plug according to claim 13, wherein the insulator includes an insulator second-diameter-reducing-portion which is located axially rearward of the insulator first-diameter-reducing-portion and whose outside diameter reduces axially rearward;

the metallic shell includes a crimped portion which forms a rear end thereof, is located axially rearward of the insulator second-diameter-reducing portion of the insulator, and is bent radially inward;

a filler space is located between the crimped portion and the insulator second-diameter-reducing-portion of the insulator and is surrounded by an inner circumferential surface of the metallic shell and an outer circumferential surface of the insulator, and is filled with a cushioning material;

a length H1 and a length H2 satisfy a relational expression $$0.13 \leq H1/H2 \leq 0.18$$

where the length H1 is parallel with the axial line and is an axial length of the filler space, and the length H2 is parallel with the axial line and is an axial length between a rear end of the filler space and a projection position of a rear end of the insulator first-diameter-reducing-portion of the insulator, the projection position being obtained by projecting the rear end of the insulator first-diameter-reducing-portion onto an inner circumferential surface of the metallic shell diameter-reducing-portion of the metallic shell in parallel with the axial line;

the metallic shell includes a groove portion located axially forward of the crimped portion and assuming the form of a depression in the inner circumferential surface thereof; and a forward end of the insulator second-diameter-reducing-portion is located axially rearward of a rear end of the groove portion.

15. The spark plug according to claim 12, wherein the insulator includes an insulator second-diameter-reducing-portion which is located axially rearward of the insulator first-diameter-reducing-portion and whose outside diameter reduces axially rearward;

the metallic shell includes a crimped portion which forms a rear end thereof, is located axially rearward of the insulator second-diameter-reducing portion of the insulator, and is bent radially inward;

a filler space is located between the crimped portion and the insulator second-diameter-reducing-portion of the insulator and is surrounded by an inner circumferential surface of the metallic shell and an outer circumferential surface of the insulator, and is filled with a cushioning material;

a length H1 and a length H2 satisfy a relational expression $$0.13 \leq H1/H2 \leq 0.18$$

where the length H1 is parallel with the axial line and is an axial length of the filler space, and the length H2 is parallel with the axial line and is an axial length between a rear end of the filler space and a projection position of a rear end of the insulator first-diameter-reducing-portion of the insulator, the projection position being obtained by projecting the rear end of the insulator first-diameter-reducing-portion onto an inner circumferential surface of the metallic shell diameter-reducing-portion of the metallic shell in parallel with the axial line;

the metallic shell includes a groove portion located axially forward of the crimped portion and assuming the form of a depression in the inner circumferential surface thereof; and a forward end of the insulator second-diameter-reducing-portion is located axially rearward of a rear end of the groove portion.

16. The spark plug according to claim 1, wherein the seal member contacts with the insulator first-diameter-reducing-portion only in an axial direction of the spark plug.

* * * * *